US006827413B1

(12) United States Patent
Kawatoko et al.

(10) Patent No.: US 6,827,413 B1
(45) Date of Patent: Dec. 7, 2004

(54) PRINTING APPARATUS, CONTROL METHOD OF THE APPARATUS, AND COMPUTER-READABLE MEMORY

(75) Inventors: Norihiro Kawatoko, Kawasaki (JP); Hiroshi Tajika, Yokohama (JP); Takayuki Murata, Kawasaki (JP); Yuji Konno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,661

(22) Filed: Jul. 28, 2000

(30) Foreign Application Priority Data

Aug. 24, 1999 (JP) ..... 11-237530
Jul. 17, 2000 (JP) ..... 2000-216265
Jul. 19, 2000 (JP) ..... 2000-219774

(51) Int. Cl.[7] ..... B41J 29/38
(52) U.S. Cl. ..... 347/14
(58) Field of Search ..... 347/5, 9, 10, 14, 347/19, 17, 60, 190, 196, 50, 57, 58, 23, 29, 35

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,510,505 | A | | 4/1985 | Fukui | 347/190 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 5,036,337 | A | * | 7/1991 | Rezanka | 347/14 |
| 5,223,853 | A | * | 6/1993 | Wysocki et al. | 347/14 |
| 5,289,207 | A | * | 2/1994 | Ebisawa | 347/29 |
| 5,497,174 | A | * | 3/1996 | Stephany et al. | 347/13 |
| 5,606,355 | A | | 2/1997 | Komatsu | 347/60 |
| 5,610,638 | A | * | 3/1997 | Courtney | 347/14 |
| 5,677,577 | A | * | 10/1997 | Barbehenn et al. | 307/98 |
| 5,880,751 | A | | 3/1999 | Nishikori et al. | 347/14 |
| 6,116,717 | A | * | 9/2000 | Anderson et al. | 347/19 |
| 6,183,056 | B1 | * | 2/2001 | Corrigan et al. | 347/14 |
| 6,189,993 | B1 | * | 2/2001 | Mantell | 347/15 |

FOREIGN PATENT DOCUMENTS

| | | | |
|---|---|---|---|
| EP | 626 266 A2 | * 11/1994 | B41J/2/355 |
| EP | 0 703 079 | 3/1996 | |
| EP | 0 750 988 | 1/1997 | |
| GB | 2 159 465 | 12/1985 | |
| JP | 54-56847 | 5/1979 | |
| JP | 58-5280 | 1/1983 | |
| JP | 59-123670 | 7/1984 | |
| JP | 59-138461 | 8/1984 | |
| JP | 60-71260 | 4/1985 | |
| JP | 5-96771 | 4/1993 | |
| JP | 5-116342 | 5/1993 | |
| JP | 5-138900 | 6/1993 | |
| JP | 6-210854 | 8/1994 | |
| JP | 8-39808 | 2/1996 | |
| JP | 9-11463 | 1/1997 | |
| JP | 9-11504 | 1/1997 | |
| JP | 9-156102 | 6/1997 | |
| JP | 10-250133 | 9/1998 | |

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

When printing data is to be printed, the number of simultaneously driven printing elements of a plurality of printing elements of a printhead is discriminated. On the basis of the number of simultaneously driven printing elements discriminated and a fundamental pulse width changeably, determined on the basis of driving conditions of the printhead, a driving pulse to be applied to printing elements used in the printing of the printing data is controlled.

44 Claims, 40 Drawing Sheets

FIG. 16

| HEATER RANK | TrON RANK | TEMPERATURE RANK | DRIVING PULSE WIDTH |
|---|---|---|---|
| 1 | 1 | ~20℃ | 1.5 |
| | | ~30℃ | 1.4 |
| | | ~40℃ | 1.3 |
| | | ~50℃ | 1.2 |
| | | 50℃ OR MORE | 1.1 |
| | 2 | ~20℃ | 1.6 |
| | | ~30℃ | 1.5 |
| | | ~40℃ | 1.4 |
| ⋮ | ⋮ | ⋮ | ⋮ |
| ⋮ | ⋮ | ⋮ | ⋮ |
| ⋮ | ⋮ | ⋮ | ⋮ |
| 8 | 8 | ~20℃ | 2.9 |
| | | ~30℃ | 2.8 |
| | | ~40℃ | 2.7 |
| | | ~50℃ | 2.6 |
| | | 50℃ OR MORE | 2.4 |

FIG. 17

| | | | THE NUMBER OF SIMULTANEOUS INK DISCHARGING NOZZLES | | | |
|---|---|---|---|---|---|---|
| HEATER RANK | TrON RANK | TEMPERATURE RANK | 0 ~ 7 | ~ 15 | ~ 23 | ~ 31 |
| 1 | 1 | ~20℃ | 1.2 | 1.3 | 1.4 | 1.5 |
| | | ~30℃ | 1.1 | 1.2 | 1.3 | 1.4 |
| | | ~40℃ | 1 | 1.1 | 1.2 | 1.3 |
| | | ~50℃ | 0.9 | 1 | 1.1 | 1.2 |
| | | 50℃ OR MORE | 0.8 | 0.9 | 1 | 1.1 |
| | 2 | ~20℃ | 1.3 | 1.4 | 1.5 | 1.6 |
| | | ~30℃ | 1.2 | 1.3 | 1.4 | 1.5 |
| | | ~40℃ | 1.1 | 1.2 | 1.3 | 1.4 |
| ⋮ | ⋮ | ⋮ | ⋮ | ⋮ | ⋮ | ⋮ |
| ⋮ | ⋮ | ⋮ | ⋮ | ⋮ | ⋮ | ⋮ |
| ⋮ | ⋮ | ⋮ | ⋮ | ⋮ | ⋮ | ⋮ |
| 8 | 8 | ~20℃ | 2.2 | 2.4 | 2.6 | 2.9 |
| | | ~30℃ | 2.2 | 2.4 | 2.6 | 2.8 |
| | | ~40℃ | 2.2 | 2.3 | 2.5 | 2.7 |
| | | ~50℃ | 2 | 2.2 | 2.3 | 2.6 |
| | | 50℃ OR MORE | 1.9 | 2.1 | 2.2 | 2.4 |

8×8×5=320

FIG. 18

| HEATER RANK | TrON RANK | TEMPERATURE RANK | DRIVING PULSE No. |
|---|---|---|---|
| 1 | 1 | ~20℃ | 5 |
| | | ~30℃ | 4 |
| | | ~40℃ | 3 |
| | | ~50℃ | 2 |
| | | 50℃ OR MORE | 1 |
| | 2 | ~20℃ | 6 |
| | | ~30℃ | 5 |
| | | ~40℃ | 4 |
| ⋮ | ⋮ | ⋮ | ⋮ |
| ⋮ | ⋮ | ⋮ | ⋮ |
| ⋮ | ⋮ | ⋮ | ⋮ |
| 8 | 8 | ~20℃ | 16 |
| | | ~30℃ | 15 |
| | | ~40℃ | 14 |
| | | ~50℃ | 13 |
| | | 50℃ OR MORE | 12 |

8×8×2=128

FIG. 19

| DRIVING PULSE No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| FUNDAMENTAL PULSE WIDTH ($\mu$S) | 0.8 | 0.9 | 1 | 1.1 | 1.2 | 1.3 | 1.4 | 1.5 | 1.6 | 1.7 | 1.8 | 1.9 | 2 | 2.1 | 2.2 | 2.2 |

FIG. 20

| DRIVING PULSE No. | THE NUMBER OF SIMULTANEOUS INK DISCHARGING NOZZLES | | | |
|---|---|---|---|---|
| | 0~7 | ~15 | ~23 | ~32 |
| 1 | 0 | 0.1 | 0.2 | 0.3 |
| 2 | 0 | 0.1 | 0.2 | 0.3 |
| 3 | 0 | 0.1 | 0.2 | 0.3 |
| 4 | 0 | 0.1 | 0.2 | 0.3 |
| 5 | 0 | 0.1 | 0.2 | 0.4 |
| 6 | 0 | 0.1 | 0.3 | 0.4 |
| 7 | 0 | 0.1 | 0.3 | 0.4 |
| 8 | 0 | 0.2 | 0.3 | 0.4 |
| 9 | 0 | 0.1 | 0.3 | 0.5 |
| 10 | 0 | 0.1 | 0.3 | 0.5 |
| 11 | 0 | 0.2 | 0.4 | 0.5 |
| 12 | 0 | 0.2 | 0.3 | 0.5 |
| 13 | 0 | 0.2 | 0.3 | 0.6 |
| 14 | 0 | 0.2 | 0.4 | 0.6 |
| 15 | 0 | 0.2 | 0.4 | 0.6 |
| 16 | 0 | 0.2 | 0.4 | 0.7 |

FIG. 24

HEAD ROM SET No. —— PULSE WIDTH

| HEAD ROM SET No. | PULSE WIDTH |
|---|---|
| 1 | 0.6 |
| 2 | 0.7 |
| 3 | 0.8 |
| 4 | 0.9 |
| ⋮ | ⋮ |
| ⋮ | ⋮ |
| ⋮ | ⋮ |
| ⋮ | ⋮ |

(AT 20 ~ 30℃)

FIG. 25

HEAD ROM SET No. — DRIVING PULSE No. CORRESPONDENCE TABLE

| HEAD ROM SET No. | TEMPERATURE RANK | | | | |
|---|---|---|---|---|---|
| | ~20℃ | ~30℃ | ~40℃ | ~50℃ | ~50℃ OR MORE |
| 4 | 5 | 4 | 3 | 2 | 1 |
| 5 | 6 | 5 | 4 | 3 | 2 |
| 6 | 7 | 6 | 5 | 4 | 3 |
| 7 | 8 | 7 | 7 | 5 | 4 |
| ⋮ | ⋮ | ⋮ | ⋮ | ⋮ | ⋮ |
| ⋮ | ⋮ | ⋮ | ⋮ | ⋮ | ⋮ |
| ⋮ | ⋮ | ⋮ | ⋮ | ⋮ | ⋮ |
| ⋮ | ⋮ | ⋮ | ⋮ | ⋮ | ⋮ |

↑ NUMBER IS DRIVING PULSE No.

FIG. 26

DRIVING PULSE No. —— P1 SET VALUE

| DRIVING PULSE No. | P1 | PULSE WIDTH |
|---|---|---|
| 1 | 14 | 0.6 |
| 2 | 13 | 0.7 |
| 3 | 12 | 0.8 |
| 4 | 11 | 0.9 |
| ... | ... | ... |
| ... | ... | ... |
| ... | ... | ... |
| ... | ... | ... |

FIG. 27

DRIVING PULSE No. —— SIMULTANEOUS INK DISCHARGING PULSE No.

| DRIVING PULSE No. | THE NUMBER OF SIMULTANEOUS INK DISCHARGING NOZZLES | | | |
|---|---|---|---|---|
| | 0~7 | ~15 | ~23 | ~32 |
| 1 | 0 | 3 | 6 | 9 |
| 2 | 0 | 3 | 6 | 9 |
| 3 | 0 | 3 | 7 | 9 |
| 4 | 0 | 4 | 7 | 10 |
| ⋮ | ⋮ | ⋮ | ⋮ | ⋮ |
| ⋮ | ⋮ | ⋮ | ⋮ | ⋮ |
| ⋮ | ⋮ | ⋮ | ⋮ | ⋮ |
| ⋮ | ⋮ | ⋮ | ⋮ | ⋮ |

↑ NUMBER IS SIMULTANEOUS DISCHARGING PULSE No.

FIG. 28

SIMULTANEOUS INK DISCHARGING PULSE No. — P2 SET VALUE

| SIMULTANEOUS INK DISCHARGING PULSE No. | P2 | PULSE MODULATION WIDTH |
|---|---|---|
| 0 | 20 | 0 |
| 1 | 21 | 0.1 |
| 2 | 22 | 0.2 |
| 3 | 23 | 0.3 |
| 4 | 24 | 0.4 |
| ⋮ | ⋮ | ⋮ |
| ⋮ | ⋮ | ⋮ |
| ⋮ | ⋮ | ⋮ |
| ⋮ | ⋮ | ⋮ |

FIG. 33

PULSE TABLE IN WHICH PULSE WIDTH IS NARROWED WHEN THE NUMBER OF SIMULTANEOUS INK DISCHARGING NOZZLES IS 16 OR MORE

| DRIVING PULSE No. | THE NUMBER OF SIMULTANEOUS INK DISCHARGING NOZZLES | | | |
|---|---|---|---|---|
| | 0~7 | ~15 | ~23 | ~32 |
| 1 | 0 | 0.1 | 0.1 | 0.2 |
| 2 | 0 | 0.1 | 0.2 | 0.2 |
| 3 | 0 | 0.1 | 0.2 | 0.3 |
| 4 | 0 | 0.1 | 0.2 | 0.3 |
| 5 | 0 | 0.1 | 0.2 | 0.3 |
| 6 | 0 | 0.1 | 0.2 | 0.3 |
| 7 | 0 | 0.1 | 0.2 | 0.3 |
| 8 | 0 | 0.2 | 0.2 | 0.3 |
| 9 | 0 | 0.1 | 0.3 | 0.3 |
| 10 | 0 | 0.1 | 0.3 | 0.3 |
| 11 | 0 | 0.2 | 0.2 | 0.3 |
| 12 | 0 | 0.2 | 0.3 | 0.4 |
| 13 | 0 | 0.2 | 0.3 | 0.4 |
| 14 | 0 | 0.2 | 0.3 | 0.4 |
| 15 | 0 | 0.2 | 0.3 | 0.5 |
| 16 | 0 | 0.2 | 0.3 | 0.5 |

EXAMPLE IN WHICH THE NUMBER OF SIMULTANEOUS INK DISCHARGING NOZZLES = 8 IS UNIFORMLY DISTRIBUTED

EXAMPLE IN WHICH THE NUMBER OF SIMULTANEOUS INK DISCHARGING NOZZLES = 8 IS CONCENTRATED TO ONE CHIP

EXAMPLE IN WHICH PULSE WIDTH IS INCREASED WHEN THE NUMBER OF SIMULTANEOUS INK DISCHARGING NOZZLES IS 0 TO 7

FIG. 37

| DRIVING PULSE No. | THE NUMBER OF SIMULTANEOUS INK DISCHARGING NOZZLES | | | |
|---|---|---|---|---|
| | 0~7 | ~15 | ~23 | ~32 |
| 1 | 0.1 | 0.1 | 0.1 | 0.2 |
| 2 | 0.1 | 0.1 | 0.2 | 0.2 |
| 3 | 0.1 | 0.1 | 0.2 | 0.3 |
| 4 | 0.1 | 0.1 | 0.2 | 0.3 |
| 5 | 0.1 | 0.1 | 0.2 | 0.3 |
| 6 | 0.1 | 0.1 | 0.2 | 0.3 |
| 7 | 0.1 | 0.1 | 0.2 | 0.3 |
| 8 | 0.1 | 0.2 | 0.2 | 0.3 |
| 9 | 0.1 | 0.1 | 0.3 | 0.3 |
| 10 | 0.1 | 0.1 | 0.3 | 0.3 |
| 11 | 0.1 | 0.2 | 0.2 | 0.3 |
| 12 | 0.1 | 0.2 | 0.3 | 0.4 |
| 13 | 0.2 | 0.2 | 0.3 | 0.4 |
| 14 | 0.1 | 0.2 | 0.3 | 0.4 |
| 15 | 0.2 | 0.2 | 0.3 | 0.5 |
| 16 | 0.2 | 0.2 | 0.3 | 0.5 |

FIG. 38

SIMULTANEOUS INK DISCHARGING PULSE No. — P2 SET VALUE

| SIMULTANEOUS INK DISCHARGING PULSE No. | P2 | PULSE MODULATION WIDTH |
|---|---|---|
| 0 | 20 | 0 |
| 1 | 21 | 0.1 |
| 2 | 22 | 0.2 |
| 3 | 23 | 0.3 |
| 4 | 24 | 0.4 |
| ⋮ | ⋮ | ⋮ |
| ⋮ | ⋮ | ⋮ |
| ⋮ | ⋮ | ⋮ |
| ⋮ | ⋮ | ⋮ |

FOR PRINTING MODE A

SIMULTANEOUS INK DISCHARGING PULSE No. — P2 SET VALUE

| SIMULTANEOUS INK DISCHARGING PULSE No. | P2 | PULSE MODULATION WIDTH |
|---|---|---|
| 0 | 21 | 0.1 |
| 1 | 22 | 0.2 |
| 2 | 23 | 0.3 |
| 3 | 24 | 0.4 |
| 4 | 25 | 0.5 |
| ⋮ | ⋮ | ⋮ |
| ⋮ | ⋮ | ⋮ |
| ⋮ | ⋮ | ⋮ |
| ⋮ | ⋮ | ⋮ |

FOR PRINTING MODE B

FIG. 39

DRIVING PULSE No. — SIMULTANEOUS INK DISCHARGING PULSE No.

| DRIVING PULSE No. | THE NUMBER OF SIMULTANEOUS INK DISCHARGING NOZZLES | | | |
|---|---|---|---|---|
| | 0~7 | ~15 | ~23 | ~32 |
| 1 | 0 | 3 | 6 | 9 |
| 2 | 0 | 3 | 6 | 9 |
| 3 | 20 | 3 | 7 | 9 |
| 4 | 20 | 4 | 7 | 10 |
| ⋮ | ⋮ | ⋮ | ⋮ | ⋮ |
| ⋮ | ⋮ | ⋮ | ⋮ | ⋮ |
| ⋮ | ⋮ | ⋮ | ⋮ | ⋮ |
| ⋮ | ⋮ | ⋮ | ⋮ | ⋮ |

FIG. 40

SIMULTANEOUS INK DISCHARGING PULSE No. — P2 SET VALUE

| SIMULTANEOUS INK DISCHARGING PULSE No. | P2 | PULSE MODULATION WIDTH |
|---|---|---|
| 0 | 20 | 0 |
| 1 | 21 | 0.1 |
| 2 | 22 | 0.2 |
| 3 | 23 | 0.3 |
| 4 | 24 | 0.4 |
| ⋮ | ⋮ | ⋮ |
| ⋮ | ⋮ | ⋮ |
| ⋮ | ⋮ | ⋮ |
| 20 | 20 | 0 |

FOR PRINTING MODE A

SIMULTANEOUS INK DISCHARGING PULSE No. — P2 SET VALUE

| SIMULTANEOUS INK DISCHARGING PULSE No. | P2 | PULSE MODULATION WIDTH |
|---|---|---|
| 0 | 21 | 0.1 |
| 1 | 22 | 0.2 |
| 2 | 23 | 0.3 |
| 3 | 24 | 0.4 |
| 4 | 25 | 0.5 |
| ⋮ | ⋮ | ⋮ |
| ⋮ | ⋮ | ⋮ |
| ⋮ | ⋮ | ⋮ |
| 20 | 22 | 0.2 |

FOR PRINTING MODE B

PRINTING APPARATUS, CONTROL METHOD OF THE APPARATUS, AND COMPUTER-READABLE MEMORY

FIELD OF THE INVENTION

The present invention relates to a printing apparatus for printing an image by using a printhead having a plurality of printing elements, a control method of the apparatus, and a computer-readable memory.

Note that the present invention is applicable not only to a general printing apparatus but also to a copying machine, a facsimile apparatus having a communication system, a word processor having a printing unit, and an industrial printing apparatus combined with various processors.

BACKGROUND OF THE INVENTION

Printing apparatuses such as a printer, a copying machine, and a facsimile apparatus are so constructed as to print an image composed of dot patterns on a printing medium such as a paper sheet or thin plastic plate on the basis of image information. Printing apparatuses like this can be classified, based on the type of printing system, into an inkjet system, a wire dot system, a thermal system, and a laser beam system. The inkjet system (inkjet printing apparatus) prints an image by discharging ink (printing solution) droplets from discharge orifices in a printhead and depositing the ink droplets on a printing medium.

Recently, a large number of printing apparatuses have been used, wherein high-speed printing, high resolution, high image quality and low noise are required. The above inkjet printing apparatus is an example of a printing apparatus meeting these requirements. This inkjet printing apparatus prints an image by discharging ink from a printhead, so noncontact printing is possible. Hence, the inkjet printing apparatus can form stable printed images on a wide variety of printing media.

Of such inkjet printing apparatuses, an apparatus using a method of printing an image by forming ink droplets by using thermal energy is simple in structure and hence has the advantage that the density of nozzles for discharging ink can be readily increased.

However, an inkjet printing apparatus requires stable discharge of ink because the apparatus prints an image by discharging ink from a printhead. That is, the printhead of an inkjet printing apparatus must have stable performance with respect to durability, environment, printhead temperature, number of simultaneously discharged ink droplets, and the like.

"Stable discharge" means a stable discharge amount, discharge speed, and discharge state (ink droplet landing position).

For this stabilization, control has been performed such that a driving pulse to be applied to a printhead is changed in accordance with the temperature of a printing apparatus main body or of the printhead.

In conventional apparatuses, the number of discharge energy generating elements to be simultaneously driven changes in accordance with an image to be printed, so an electric current flowing from the power supply of the main body fluctuates. This changes the voltage drop resulting from the resistance of a wire connecting the main body and the printhead. Therefore, when a predetermined voltage is applied to the printhead, the voltage applied to the discharge energy generating elements in the printhead fluctuates for each image to be printed.

For example, in a general inkjet printing apparatus, the wiring resistance between the main body and the printhead is about 0.2Ω, and the head contact resistance is about 0.1Ω, so the total resistance is about 0.3Ω. Assume that a driving current of 100 to 200 mA flows through each discharge energy generating element and twenty-four elements are simultaneously driven, the total current is 2.4 to 4.8 A, and the voltage drop by the wiring is as high as 0.3Ω×(2.4 to 4.8 A)=0.72 to 1.44 V. This is the voltage fluctuation applied to the discharge energy generating elements.

This voltage fluctuation applied to the discharge energy generating elements results in fluctuations in discharge energy, i.e., fluctuations in ink discharge amount and discharge speed. Consequently, printing density unevenness or ink droplet landing position deviation takes place, or no ink droplet is discharged. This significantly degrades the printing quality.

Also, the number of simultaneous ink discharging nozzles changes the voltage to be applied to a heater of each nozzle of the printhead. A driving voltage and a driving pulse are so determined that ink droplets are stably discharged even when the number of simultaneous ink discharging nozzles is a maximum, i.e., even when the driving voltage is a maximum. When the number of simultaneous ink discharging nozzles is small, therefore, an excess driving voltage or an excess pulse width of a driving pulse is applied to the heaters, and this degrades the durability.

To solve these problems, diverse methods have been conventionally proposed.

For example, Japanese Patent Laid-Open No. 58-5280 has proposed a thermal dot printing apparatus which changes the driving pulse width and the driving interval in accordance with the number of dots to be simultaneously driven.

Also, Japanese Patent Laid-Open No. 5-96771 has proposed a thermal transfer printing apparatus which changes the driving time by detecting the number of resistors to be powered in order to correct the voltage drop in a common wiring portion.

Japanese Patent Laid-Open No. 5-116342 has proposed an inkjet printing apparatus in which a detecting unit using an MPU and a RAM detects the number of dots to be simultaneously discharged and the driving voltage is controlled by using the detection result.

Japanese Patent Laid-Open No. 9-11463 has proposed an inkjet printing apparatus in which an image signal from a host apparatus or the like is temporarily stored in a buffer and converted into a bit signal for each heat-generating resistor in an inkjet printhead by an image processing circuit, and the driving pulse conditions are determined by using a lookup table on the basis of the number of dots to be discharged, the positions of nozzles, and temperature information obtained from a thermistor added to the inkjet printhead.

Furthermore, Japanese Patent Laid-Open No. 9-11504 has proposed an inkjet printing apparatus which counts the number of nozzles to be simultaneously driven in a printhead, stores driving parameters in a RAM on the basis of this counted value, and uses these stored driving parameters.

The foregoing are the conventional examples of driving pulse width control for improving the printing stability and the conventional examples of driving pulse width control based on the number of simultaneous ink discharging nozzles. As described above, driving pulse width control is performed for various purposes. When the driving pulse width is changed in accordance with the temperature, the voltage drop by simultaneous discharge also changes. This complicates the process of appropriate control. Also, while the driving frequency of a printhead increases from ten-odd KHz to several tens of KHz with recent improvements in printing speed and printing quality, the amount of printing data is increasing. This makes the conventional method of previously counting printing data difficult to perform.

SUMMARY OF THE INVENTION

The present invention has been made in consideration of the above problems, and has as its object to provide a printing apparatus capable of stable printing, a control method of the apparatus, and a computer-readable memory.

A printing apparatus according to the present invention, for achieving the above object, has the following arrangement.

A printing apparatus for performing printing by using a printhead having a plurality of printing elements comprises discriminating means for discriminating the number of simultaneously driven printing elements of the plurality of printing elements when printing data is printed, and control means for controlling a driving pulse to be applied to printing elements used in the printing of the printing data, on the basis of a fundamental pulse width. The fundamental pulse width is variable and is determined on the basis of driving conditions of the printhead and the number of simultaneously driven printing elements discriminated by the discriminating means.

Preferably, the driving conditions include a wiring resistance, heater resistance, driving TrON resistance, and environmental temperature of the printhead.

Preferably, the control means comprises storage means for storing a first management table for managing the correspondence of the driving conditions with the fundamental pulse width, and a second management table for managing the correspondence of the fundamental pulse width with a change amount of the fundamental pulse width based on the number of simultaneously driven printing elements; first determining means for determining a fundamental pulse width corresponding to the driving conditions by referring to the first management table; and second determining means for determining a change amount of the fundamental pulse width, which corresponds to the number of simultaneously driven printing elements, by referring to the second management table, and changes the fundamental pulse width determined by the first determining means by the change amount determined by the second determining means to generate a driving pulse to be applied to printing elements used in the printing of the printing data.

Preferably, the control means defines the fundamental pulse width by one of leading and trailing edges of a pulse signal on the basis of the driving conditions, and controls a driving pulse width of a driving pulse to be applied to printing elements by the other, on the basis of the number of simultaneously driven printing elements.

Preferably, the control means comprises storage means for storing a third management table for managing the correspondence of rise time and fall time of the heat pulse, the driving conditions, and the fundamental pulse width, and controls a pulse width of the driving pulse corresponding to the number of simultaneously driven printing elements and the driving conditions by referring to the third management table.

Preferably, the printing apparatus comprises a plurality of printheads, and if power lines for supplying power to the printheads are independent of each other, the control means executes the control for each power line.

Preferably, the control means makes a change amount for the driving pulse, which the control means generates by changing a pulse width of the fundamental pulse when the number of simultaneously driven printing elements is equal to or larger than a predetermined value, smaller than a change amount for the driving pulse, which the control means generates by changing a pulse width of the fundamental pulse when the number of simultaneously driven printing elements is less than the predetermined value.

Preferably, the control means makes a change amount for the driving pulse, which the control means generates by changing a pulse width of the fundamental pulse when the number of simultaneously driven printing elements is equal to or smaller than a predetermined value, larger than a change amount for the driving pulse, which the control means generates by changing a pulse width of the fundamental pulse when the number of simultaneously driven printing elements is less than the predetermined value.

Preferably, if the number of simultaneously driven printing elements for use in predischarge of the printhead is limited, the control means makes a pulse width of a driving pulse applied to printing elements used in the predischarge larger than a pulse width of a driving pulse applied to printing elements for use in printing, which uses an equal or larger number of printing elements than the number of simultaneously driven printing elements used in predischarge.

Preferably, when predischarge of the printhead is to be performed, the control means applies a driving pulse having a predetermined width to printing elements used in the predischarge.

Preferably, the fundamental pulse width is a fundamental pulse width selected and determined from a plurality of fundamental pulse widths.

Preferably, the driving conditions are conditions including printhead characteristics.

Preferably, the second management table holds as an index value a change in fundamental pulse width which is based on the number of simultaneously driven printing elements.

Preferably, a fourth management table representing a relationship between the change in fundamental pulse width and the index value, the fourth management table being prepared for each printing mode.

Preferably, the printing mode is a mode for performing printing complementarily in accordance with a printing pass count.

A method of controlling a printing apparatus according to the present invention for achieving the above object has the following steps.

A method of controlling a printing apparatus for performing printing by using a printhead having a plurality of printing elements comprises the discrimination step of discriminating the number of simultaneously driven printing elements of the plurality of printing elements when printing data is printed, and the control step of controlling a driving pulse to be applied to printing elements used in the printing of the printing data, on the basis of the number of simultaneously driven printing elements discriminated in the discrimination step and a fundamental pulse width determined on the basis of driving conditions of the printhead.

A computer-readable memory according to the present invention for achieving the above object has the following program codes.

A computer-readable memory storing program codes for control of a printing apparatus for performing printing by using a printhead having a plurality of printing elements comprises a program code of the discrimination step of discriminating the number of simultaneously driven printing elements of the plurality of printing elements when printing data is printed, and a program code of the control step of controlling a driving pulse to be applied to the printing elements used in the printing of the printing data, on the basis of the number of simultaneously driven printing elements discriminated in the discrimination step and a fundamental pulse width determined on the basis of driving conditions of the printhead.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 16 is a view showing a conventional driving pulse width table;

FIG. 17 is a view showing a conventional pulse width LUT for modulating the driving pulse width on the basis of the number of simultaneous ink discharging nozzles;

FIG. 18 is a view showing a driving pulse width table of the first embodiment;

FIG. 19 is a view showing another driving pulse width table of the first embodiment;

FIG. 20 is a view showing still another driving pulse width table of the first embodiment;

FIG. 24 is a view showing a driving pulse width table with respect to FIG. 23 of the first embodiment;

FIG. 25 is a view showing another driving pulse width table with respect to FIG. 23 of the first embodiment;

FIG. 26 is a view showing still another driving pulse width table with respect to FIG. 23 of the first embodiment;

FIG. 27 is a view showing still another driving pulse width table with respect to FIG. 23 of the first embodiment;

FIG. 28 is a view showing still another driving pulse width table with respect to FIG. 23 of the first embodiment;

FIG. 33 is a view showing a driving pulse width table with respect to FIG. 32 of the second embodiment;

FIG. 37 is a view showing a driving pulse width table with respect to FIG. 36 of the second embodiment.

FIG. 38 is a view showing a driving pulse width table of the second embodiment.

FIG. 39 is a view showing a driving pulse width table of the second embodiment.

FIG. 40 is a view showing a driving pulse width table of the second embodiment.

DETAILED DESCRIPTION OF THE PREFERRED EMBODIMENTS

Embodiments according to a printing apparatus of the present invention will be described below with reference to the accompanying drawings.

In the embodiments to be explained below, a printing apparatus using an inkjet printing system will be described by taking a printer as an example.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[Apparatus Main Body]

Figure 1:
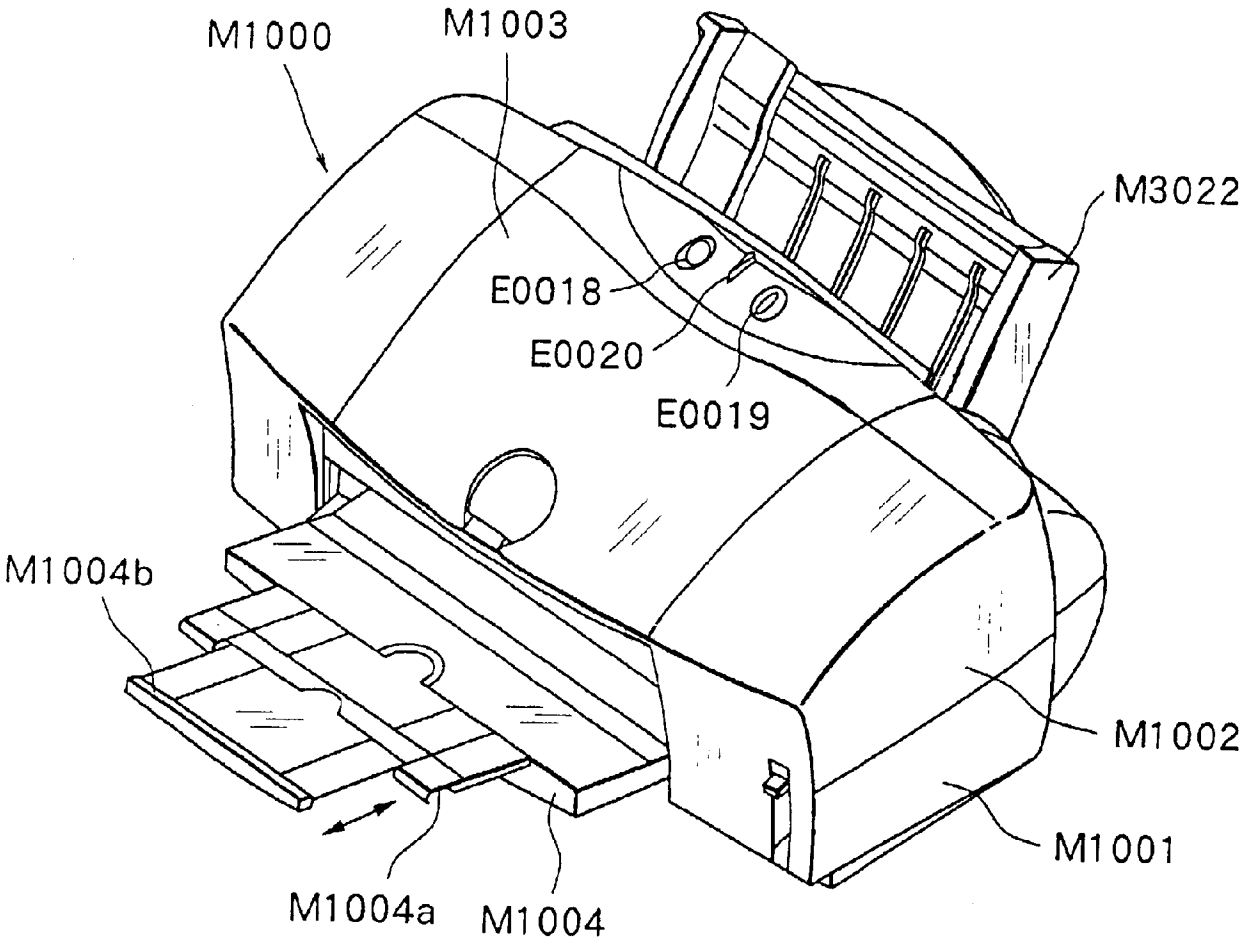
FIG. 1 is a perspective view showing the external appearance of an inkjet printer according to an embodiment of the present invention.
Figure 2:
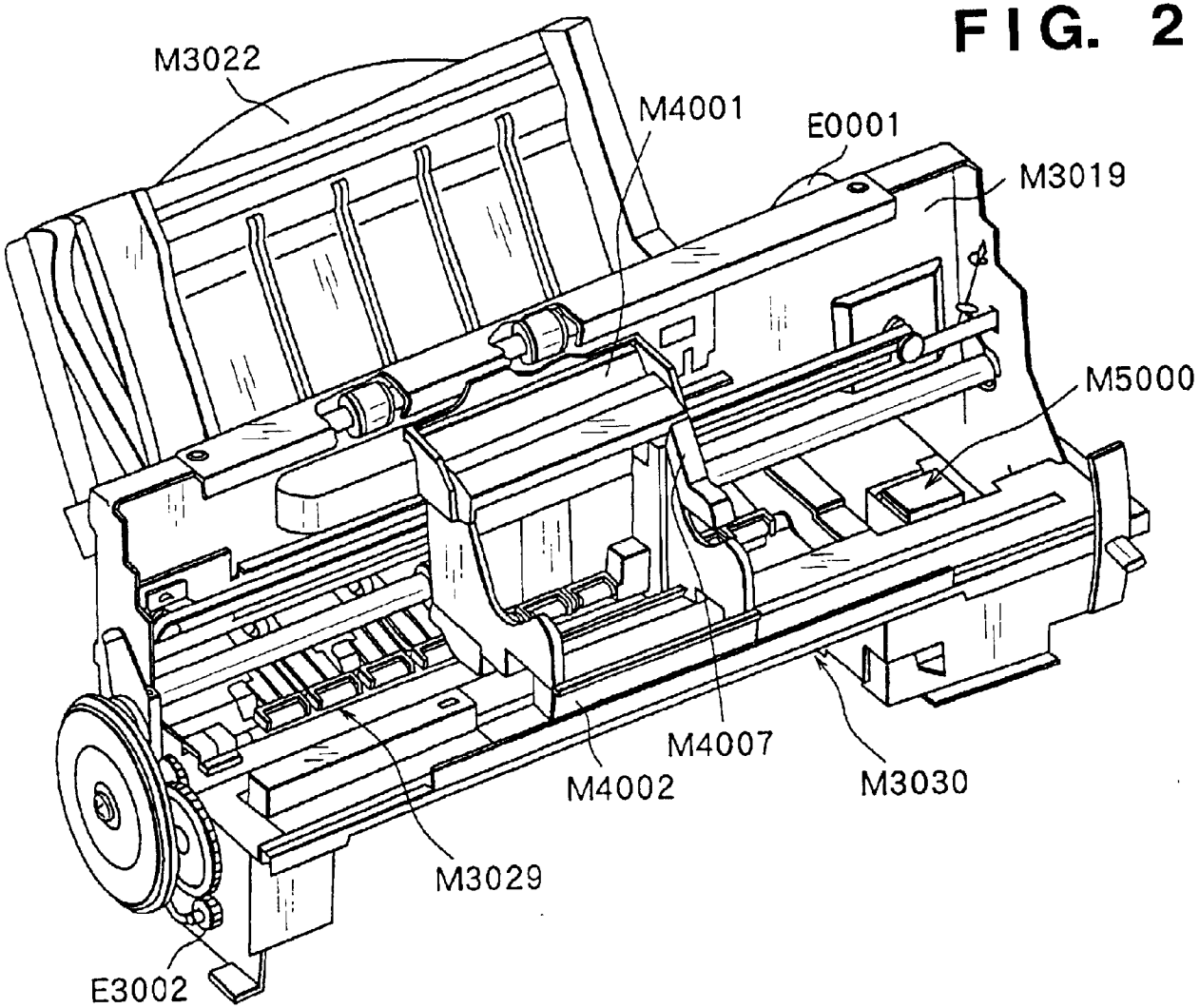
FIG. 2 is a perspective view showing the state in which external parts of the printer shown in FIG. 1 are removed.

FIGS. 1 and 2 show an outline of the arrangement of a printer using an inkjet printing system. Referring to FIG. 1, an apparatus main body M1000 as a shell of the printer according to this embodiment is composed of external members, i.e., a lower case M1001, upper case M1002, access cover M1003, and delivery tray M1004, and a chassis M3019 (FIG. 2) accommodated in these external members.

The chassis M3019 is made of a plurality of plate-like metal members having predetermined stiffness, forms a framework of the printing apparatus, and holds various printing mechanisms to be described later.

The lower case M1001 forms a substantially lower half of the apparatus main body M1000, and the upper case M1002 forms a substantially upper half of the apparatus main body M1000. The combination of these two cases forms a hollow structure having a housing space for housing diverse mechanisms to be described later. Openings are formed in the top surface and the front surface of this hollow structure.

One end portion of the delivery tray M1004 is rotatably held by the lower case M1001. By rotating this delivery tray M1004, the opening formed in the front surface of the lower case M1001 can be opened and closed. When printing is to be executed, therefore, the delivery tray M1004 is rotated forward to open the opening to allow printing sheets to be delivered from this opening, and delivered printing sheets P can be stacked in order. Also, the delivery tray M1004 accommodates two auxiliary trays M1004*a* and M1004*b*. By pulling each tray forward as needed, the sheet support area can be increased and reduced in three steps.

One end portion of the access cover M1003 is rotatably held by the upper case M1002. This allows this access cover M1003 to open and close the opening formed in the top surface of the upper case M1002. By opening this access cover M1003, a printhead cartridge H1000 or an ink tank H1900 housed inside the main body can be replaced. Although not shown, when the access cover M1003 is opened or closed, a projection formed on the rear surface of this access cover M1003 rotates a cover opening/closing lever. A microswitch or the like detects the rotated position of this lever. In this way, the open/closed state of the access cover can be detected.

Figure 7:
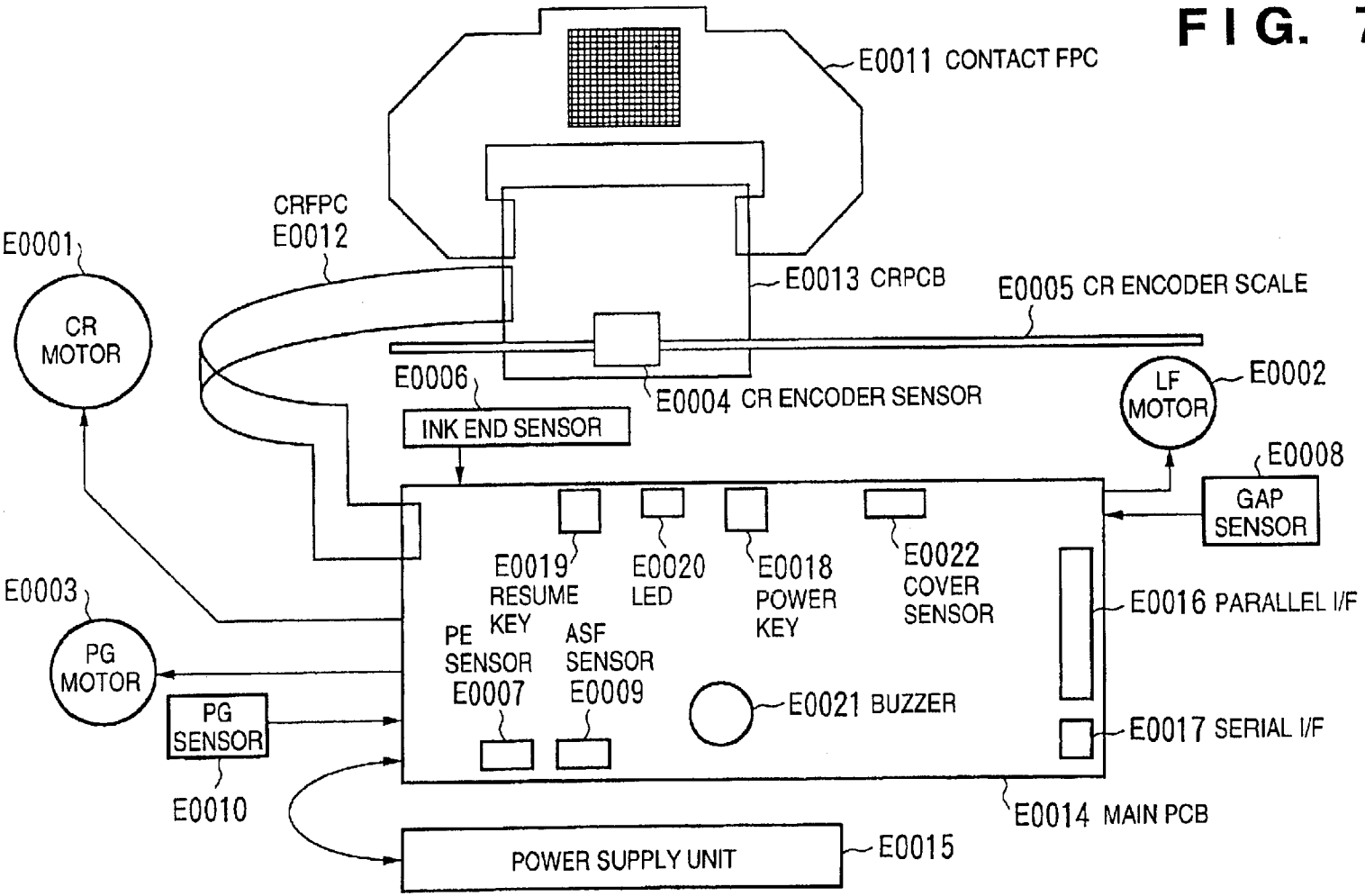
FIG. 7 is a block diagram schematically showing the overall arrangement of an electronic circuit in the embodiment of the present invention.

On the top surface in the rear portion of the upper case M1002, a power key E0018 and a resume key E0019 are arranged to be able to be pressed, and an LED E0020 is also arranged. When the power key E0018 is pressed, the LED E0020 is turned on to inform the operator that printing is possible. This LED E0020 has various display functions, e.g., informs the operator of a trouble of the printer by changing the way the LED E0020 turns on and off, changing the color of light, or sounding a buzzer E0021 (FIG. 7). When the trouble is solved, printing is restarted by pressing the resume key E0019.

[Printing Mechanisms]

Printing mechanisms of this embodiment housed in and held by the apparatus main body M1000 of the above printer will be described below.

The printing mechanisms according to this embodiment are: an automatic feeder M3022 for automatically feeding the printing sheets P into the apparatus main body; a conveyor unit M3029 for guiding the printing sheets P fed one by one from the automatic feeder to a desired printing position and guiding these recording sheets P from the printing position to a delivery unit M3030; a printing unit for performing desired printing on each printing sheet P conveyed by the conveyor unit M3029; and a recovery unit (M5000) for recovering, e.g., the printing unit.

(Printing Unit)

The printing unit will be described below.

This printing unit includes a carriage M4001 movably supported by a carriage shaft M4021, and the printhead cartridge H1000 detachably mounted on this carriage M4001.

Printhead Cartridge

First, the printhead cartridge will be described with reference to FIGS. 3 to 5.

Figure 3:
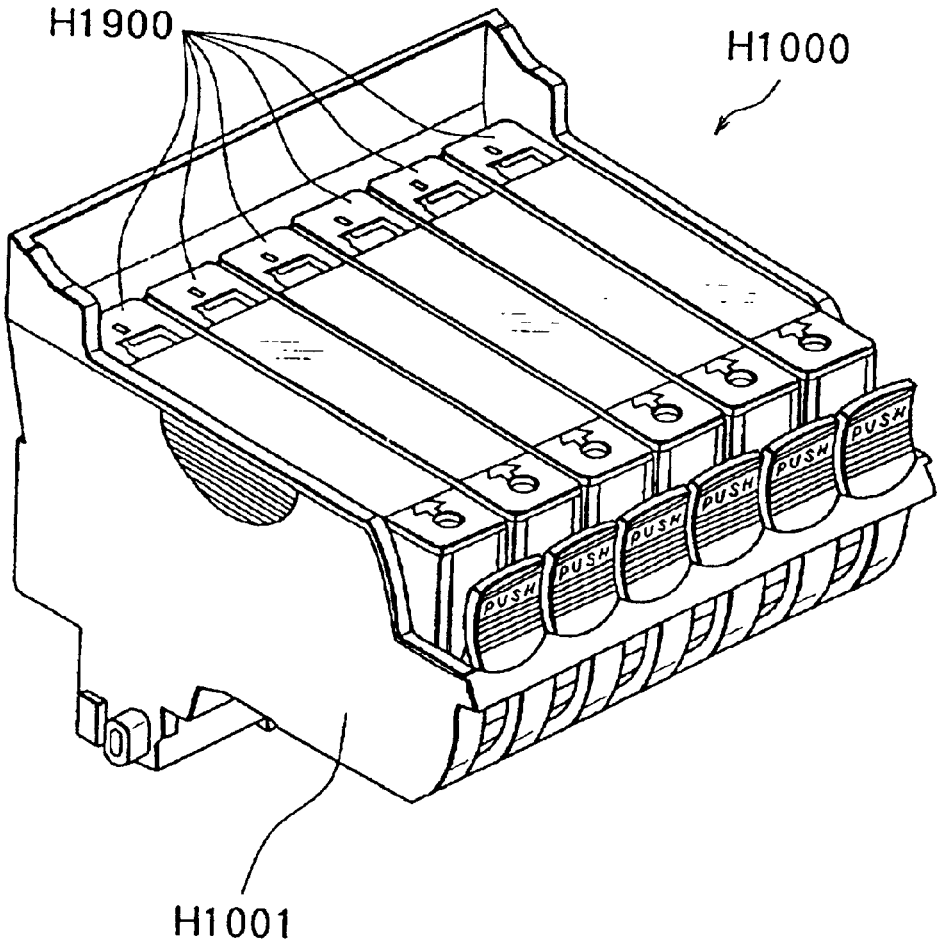
FIG. 3 is an exploded perspective view showing a printhead cartridge used in the embodiment of the present invention.
Figure 4:
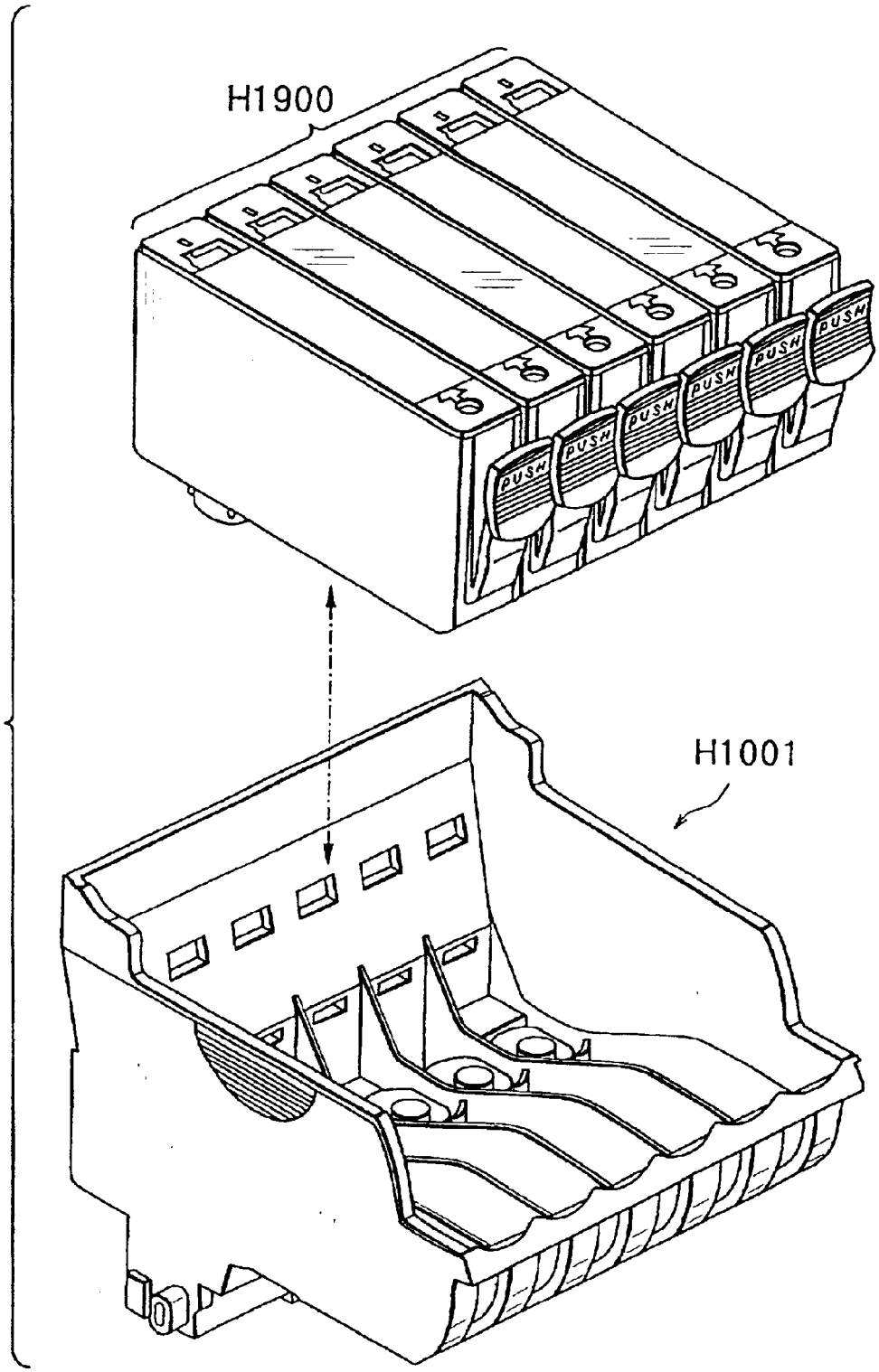
FIG. 4 is a side view showing the state in which the printhead cartridge shown in FIG. 3 is assembled.

As shown in FIG. 3, the printhead cartridge H1000 of this embodiment has the ink tank H1900 containing ink and a printhead H1001 for discharging the ink supplied from this ink tank H1900 from nozzles in accordance with printing information. This printhead H1001 is of a so-called cartridge type detachably mounted on the carriage M4001 (to be described later).

To make photographic high-quality color printing feasible, the printhead cartridge H1000 of this embodiment includes independent color ink tanks, e.g., black, light cyan, light magenta, cyan, magenta, and yellow ink tanks. As shown in FIG. 4, these ink tanks can be independently attached to and detached from the printhead H1001.

Figure 5:
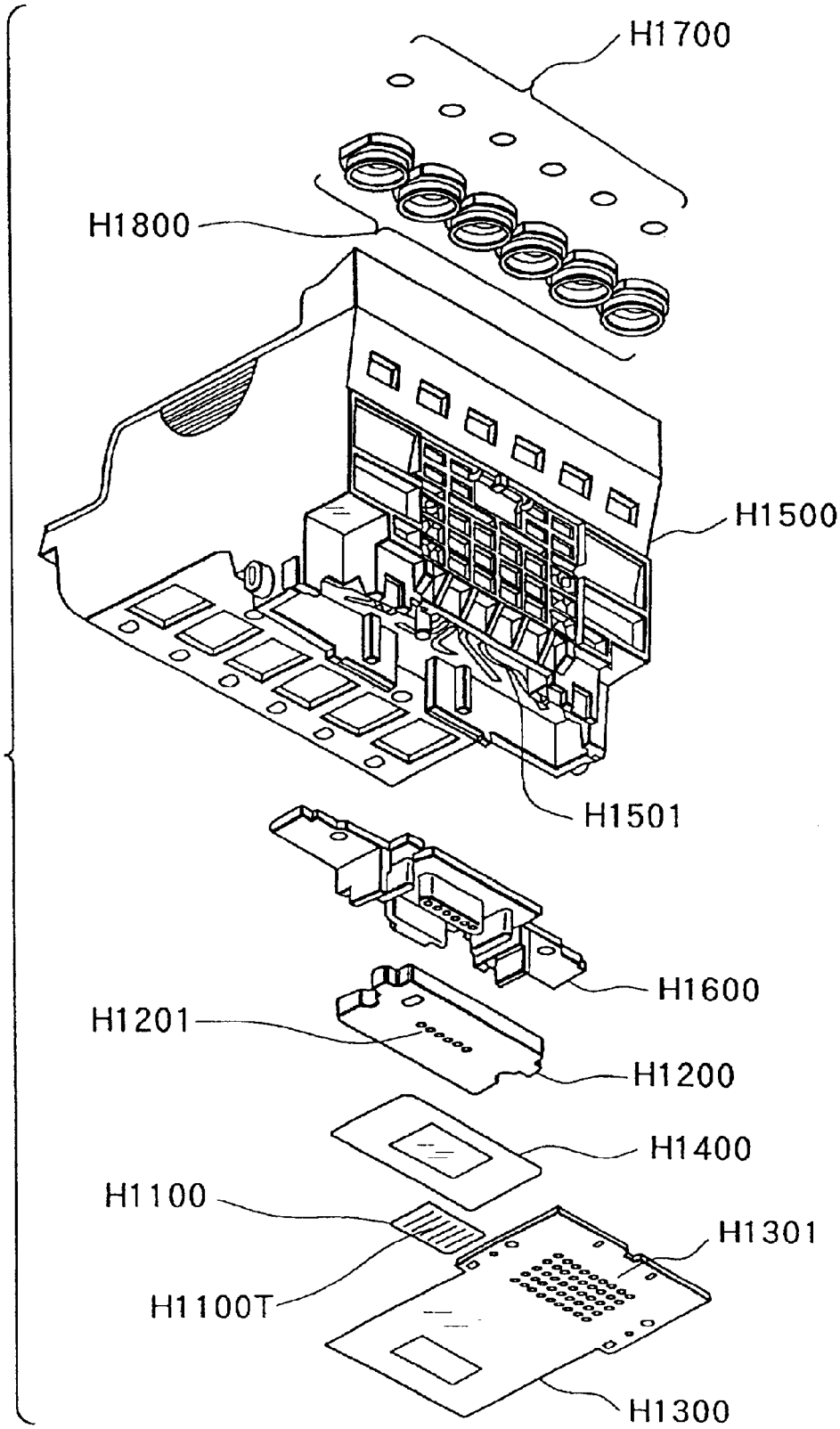
FIG. 5 is a perspective view showing the printhead of FIG. 4 when obliquely viewed from below.

As shown in an exploded perspective view of FIG. 5, the printhead H1001 comprises a printing element board H1100, first plate H1200, electrical printed circuit board H1300, second plate H1400, tank holder H1500, channel forming member H1600, filters H1700, and sealing rubber members H1800.

On the printing element board H1100, a plurality of printing elements for discharging ink and electric lines made of, e.g., Al for supplying electric power to these printing elements are formed on one surface of an Si substrate by film formation technologies. A plurality of ink channels and a plurality of discharge orifices H1100T corresponding to the printing elements are formed by photolithography. Also, ink supply ports for supplying ink to these ink channels are formed in the rear surface. This printing element board H1100 is fixed to the first plate H1200 by adhesion. Ink supply ports H1201 for supplying ink to the printing element board H1100 are formed in this first plate H1200. Furthermore, the second plate H1400 having an opening is fixed to the first plate H1200 by adhesion. This second plate H1400 holds the electric printed circuit board 1300 such that the electric printed circuit board H1300 and the printing element board H1100 are electrically connected.

This electric printed circuit board H1300 applies an electrical signal for discharging ink to the printing element board H1100. The electric printed circuit board H1300 has electric lines corresponding to the printing element board H1100, and external signal input terminals H1301 formed in end portions of these electric lines to receive electrical signals from the main body. The external signal input terminals H1301 are positioned and fixed at the back of the tank holder H1500.

The channel forming member H1600 is ultrasonically welded to the tank holder H1500 for detachably holding the ink tanks H1900, thereby forming ink channels H1501 from the ink tanks H1900 to the first plate H1200. Also, the filters H1700 are formed at those end portions of the ink channels H1501, which engage with the ink tanks H1900, to prevent invasion of dust from the outside. The sealing rubber members H1800 are attached to the portions engaging with the ink tanks H1900 to prevent evaporation of ink from these engaging portions.

Furthermore, the printhead H1001 is constructed by bonding, by an adhesive or the like, a tank holder unit composed of the tank holder H1500, channel forming member H1600, filters H1700, and sealing rubber members H1800 to a printing element unit composed of the printing element board H1100, first plate H1200, electric printed circuit board H1300, and second plate H1400.

(Carriage)

The carriage M4001 will be described below with reference to FIG. 2.

As shown in FIG. 2, this carriage M4001 includes a carriage cover M4002 and head set lever M4007. The carriage cover M4002 engages with the carriage M4001 and guides the printhead H1001 to the mount position of the carriage M4001. The head set lever M4007 engages with the tank holder H1500 of the printhead H1001 and pushes the printhead H1000 such that the printhead H1000 is set in a predetermined mount position.

That is, the head set lever M4007 is set in the upper portion of the carriage M4001 so as to be pivotal about a head set level shaft. Also, a head set plate (not shown) is set via a spring in a portion which engages with the printhead H1001. By the force of this spring, the printhead H1001 is pushed and mounted on the carriage M4001.

A contact flexible print cable (to be referred to as a contact FPC hereinafter) E0011 is set in another engaging portion of the carriage M4001 with respect to the printhead H1001. Contact portions E0011*a* on this contact FPC E0011 and the contact portions (external signal input terminals) H1301 formed on the printhead H1001 electrically contact each other to exchange various pieces of information for printing or supply electric power to the printhead H1001.

An elastic member (not shown) made of, e.g., rubber is formed between the contact portions E0011*a* of the contact FPC E0011 and the carriage M4001. The elastic force of this elastic member and the biasing force of the head set lever spring make reliable contact between the contact portions E0011*a* and the carriage M4001 possible. Furthermore, the contact FPC E0011 is connected to a carriage printed circuit board E0013 mounted on the back surface of the carriage M4001 (FIG. 7).

[Scanner]

The printer of this embodiment is also usable as a reading apparatus by replacing the printhead with a scanner.

This scanner moves together with the carriage of the printer and reads an original image supplied instead of a printing medium in a sub-scan direction. Information of one original image is read by alternately performing the read operation and the original feed operation.

Figure 6B:
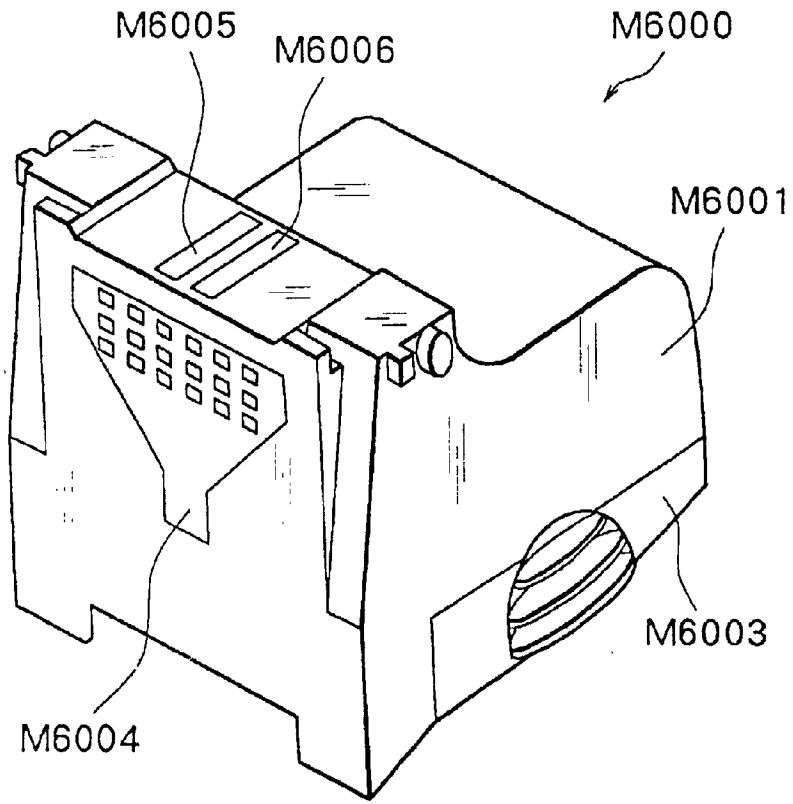
FIGS. 6A and 6B are perspective views showing a scanner cartridge in the embodiment of the present invention.
Figure 6A:
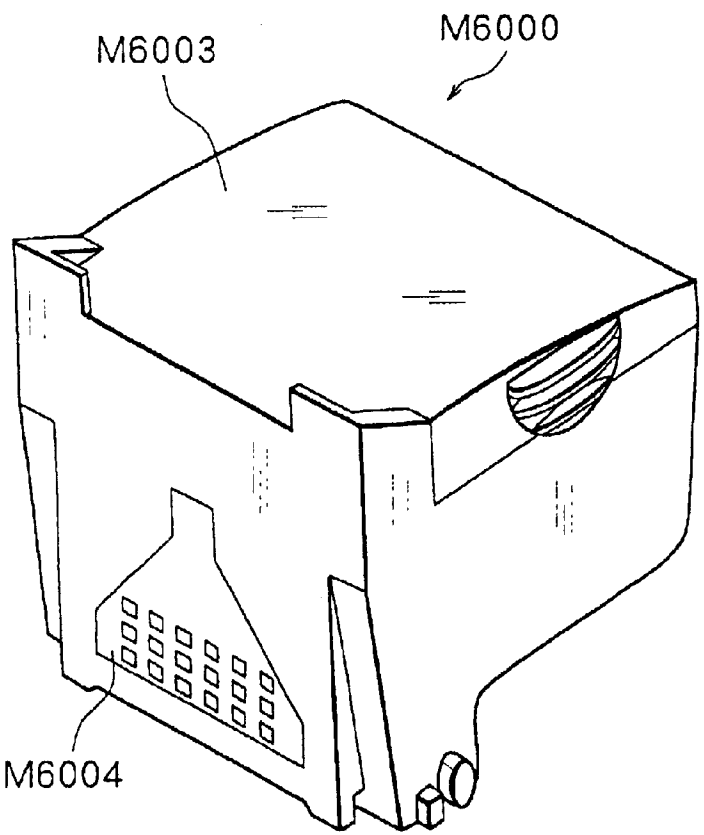

FIGS. 6A and 6B are views showing an outline of the arrangement of this scanner M6000.

As shown in FIGS. 6A and 6B, a scanner holder M6001 has a box-like shape and contains optical systems and processing circuits necessary for reading. A scanner read lens M6006 is placed in a portion which faces the surface of an original when this scanner M6000 is mounted on the carriage M4001. This scanner read lens M6006 reads an original image. A scanner illuminating lens M6005 contains a light source (not shown), and light emitted by this light source irradiates an original.

A scanner cover M6003 fixed to the bottom portion of the scanner holder M6001 so fits as to shield the interior of the scanner holder M6001 from light. Louver-like handles formed on the side surfaces of this scanner cover M6003 facilitate attachment to and detachment from the carriage M4001. The external shape of the scanner holder M6001 is substantially the same as the printhead cartridge H1000. So, the scanner holder M6001 can be attached to and detached from the carriage M4001 by operations similar to the printhead cartridge H1000.

Also, the scanner holder M6001 accommodates a board having the processing circuits described above and a scanner contact PCB M6004 connected to this board and exposed to the outside. When the scanner M6000 is mounted on the carriage M4001, this scanner contact PCB M6004 comes in contact with the contact FPC E0011 of the carriage M4001, thereby electrically connecting the board to the control system of the main body via the carriage M4001.

An electric circuit configuration in this embodiment of the present invention will be described next.

FIG. 7 is a view schematically showing the overall arrangement of an electric circuit in this embodiment.

The electric circuit of this embodiment primarily comprises the carriage printed circuit board (CRPCB) E0013, a main PCB (Printed Circuit Board) E0014, and a power supply unit E0015.

The power supply unit is connected to the main PCB E0014 to supply various driving power.

The carriage printed circuit board E0013 is a printed circuit board unit mounted on the carriage M4001 (FIG. 2) and functions as an interface for exchanging signals with the printhead through the contact FPC E0011. Also, on the basis of a pulse signal output from an encoder sensor E0004 in accordance with the movement of the carriage M4001, the carriage printed circuit board E0013 detects changes in the positional relationship between an encoder scale E0005 and the encoder sensor E0004 and outputs a signal to the main PCB E0014 through a flexible flat cable (CRFFC) E0012.

The main PCB is a printed circuit board unit for controlling driving of individual parts of the inkjet printing apparatus of this embodiment. This main PCB has, on the board, I/O ports for, e.g., a paper end sensor (PE sensor) E0007, an ASF sensor E0009, a cover sensor E0022, a parallel interface (parallel I/F) E0016, a serial interface (serial I/F) E0017, the resume key E0019, the LED E0020, the power key E0018, and the buzzer E0021. The main PCB is also connected to a CR motor E0001, an LF motor E0002, and a PG motor E0003 to control driving of these motors. Additionally, the main PCB has interfaces connecting to an ink end sensor E0006, a GAP sensor E0008, a PG sensor E0010, a CRFFC E0012, and the power supply unit E0015.

Figure 8:
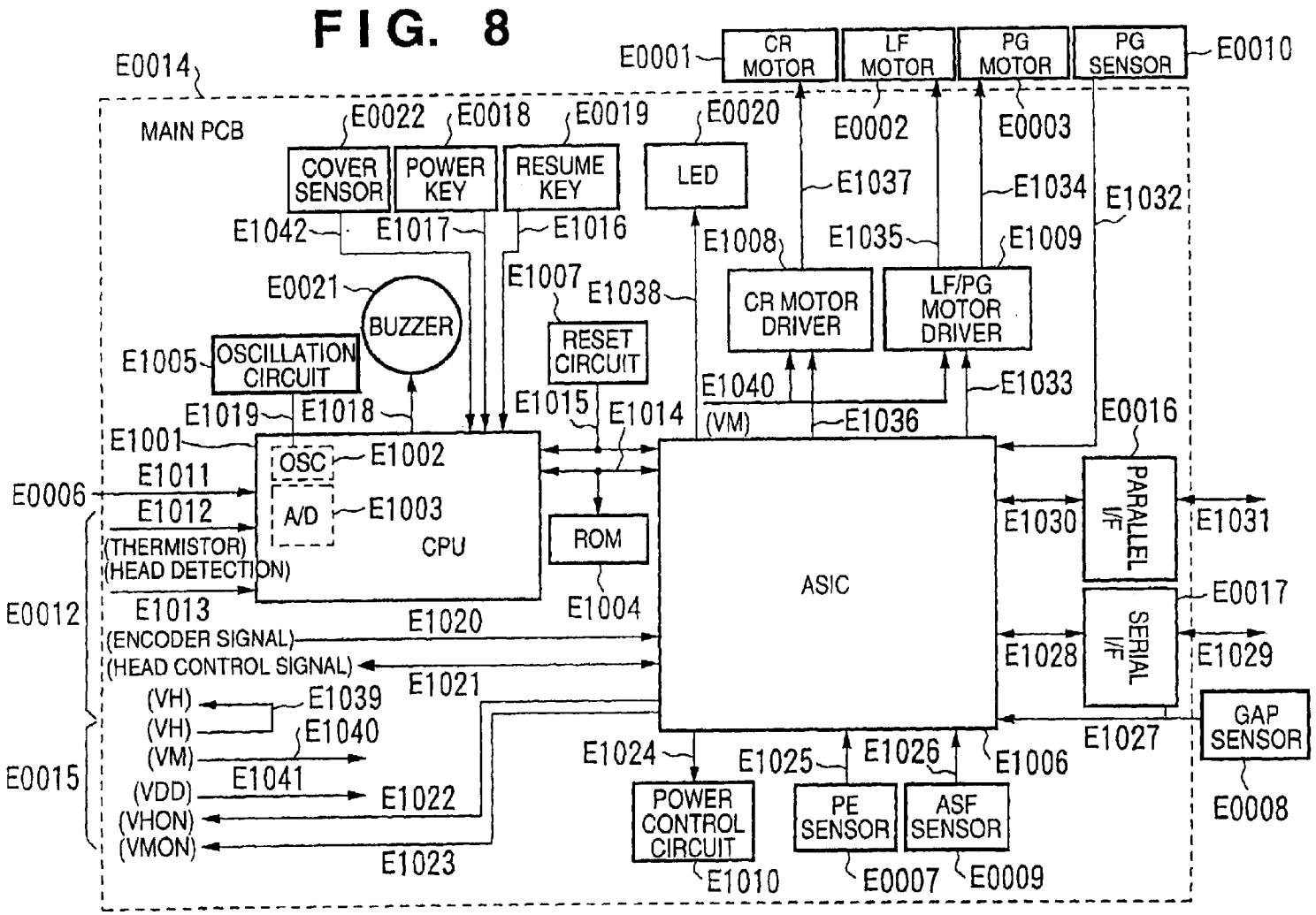
FIG. 8 is a block diagram showing the internal arrangement of a main PCB shown in FIG. 7.

FIG. 8 is a block diagram showing the internal arrangement of the main PCB.

Referring to FIG. 8, a CPU E1001 internally has an oscillator OSC E1002 and is connected to an oscillation circuit E1005 to generate a system clock by an output signal E1019 from the oscillation circuit E1005. Also, the CPU E1001 is connected to a ROM E1004 and an ASIC (Application Specific Integrated Circuit) E1006. In accordance with programs stored in the ROM E1004, the CPU E1001 controls the ASIC and senses the statuses of an input signal E1017 from the power key, an input signal E1016 from the resume key, a cover sensing signal E1042, and a head sensing signal (HSENS) E1013. Additionally, the CPU E1001 drives the buzzer E0021 by a buzzer signal (BUZ) E1018 and senses the statuses of an ink end sensing signal (INKS) E1011 and a thermistor temperature sensing signal (TH) E1012 connected to a built-in A/D converter E1003. Furthermore, the CPU E1001 controls driving of the inkjet printing apparatus by performing various logic operations and condition judgements.

The head sensing signal E1013 is a head mounting sensing signal which the printhead cartridge H1000 inputs via the flexible flat cable E0012, the carriage printed circuit board E0013, and the contact flexible print cable E0011. The ink end sensing signal is an output analog signal from the ink end sensor E0006. The thermistor temperature sensing signal E1012 is an analog signal from a thermistor (not shown) formed on the carriage printed circuit board E0013.

A CR motor driver E1008 is supplied with motor power (VM) E1040 as a driving source. In accordance with a CR motor control signal E1036 from the ASIC E1006, the CR motor driver E1008 generates a CR motor driving signal E1037 to drive the CR motor E0001. An LF/PG motor driver E1009 is also supplied with the motor power E1040 as a driving source. In accordance with a pulse motor control signal (PM control signal) E1033 from the ASIC E1006, the LF/PG motor driver E1009 generates an LF motor-driving signal E1035 to drive the LF motor and also generates a PG motor driving signal E1034 to drive the PG motor.

A power control circuit E1010 controls power supply to each sensor having a light-emitting element, in accordance with a power control signal E1024 from the ASIC E1006. The parallel I/F E0016 transmits a parallel I/F signal E1030 from the ASIC E1006 to a parallel I/F cable E1031 connected to the outside, and transmits signals from this parallel I/F cable E1031 to the ASIC E1006. The serial IF E0017 transmits a serial I/F signal E1028 from the ASIC E1006 to a serial I/F cable E1029 connected to the outside, and transmits signals from this cable E1029 to the ASIC E1006.

The power supply unit E0015 supplies head power (VH) E1039, motor power (VM) E1040, and logic power (VDD) E1041. A head power ON signal (VHON) E1022 and a motor power ON signal (VMOM) E1023 from the ASIC E1006 are input to the power supply unit E0015 to control ON/OFF of the head power E1039 and the motor power E1040, respectively. The logic power (VDD) E1041 supplied from the power supply unit E0015 is subjected to voltage transformation where necessary and supplied to individual units inside and outside the main PCB E0014.

The head power E1039 is smoothed on the main PCB E0014, supplied to the flexible flat cable E0011, and used to drive the printhead cartridge H1000.

A reset circuit E1007 detects a decrease in the logic power-supply voltage E1040 and supplies a reset signal (RESET) E1015 to the CPU E1001 and the ASIC E1006 to initialize them.

This ASIC E1006 is a one-chip semiconductor integrated circuit which is controlled by the CPU E1001 via a control bus E1014, outputs the CR motor control signal E1036, the PM control signal E1033, the power control signal E1024, the head power ON signal E1022, and the motor power ON signal E1023, and exchanges signals with the parallel I/F E10016 and the serial I/F E0017. Also, the ASIC E1006 senses the statuses of a PE sensing signal (PES) E1025 from the PE sensor E0007, an ASF sensing signal (ASFS) E1026 from the ASF sensor E0009, a GAP sensing signal (GAPS) E1027 from the GAP sensor E0008, and a PG sensing signal (PGS) E1032 from the PG sensor E0010, and transmits data indicating the statuses to the CPU E1001 through the control bus E1014. On the basis of the input data, the CPU E1001 controls driving of the LED driving signal E1038 to turn on and off the LED E0020.

Furthermore, the ASIC E1006 senses the status of an encoder signal (ENS) E1020 to generate a timing signal and interfaces with the printhead cartridge H1000 by a head control signal E1021, thereby controlling a printing operation. The encoder signal (ENC) E1020 is an output signal from the CR encoder sensor E0004, that is input through the flexible flat cable E0012. The head control signal E1021 is supplied to the printhead cartridge E1000 through the flexible flat cable E0012, the carriage printed circuit board E0013, and the contact FPC E0011.

Figure 9:
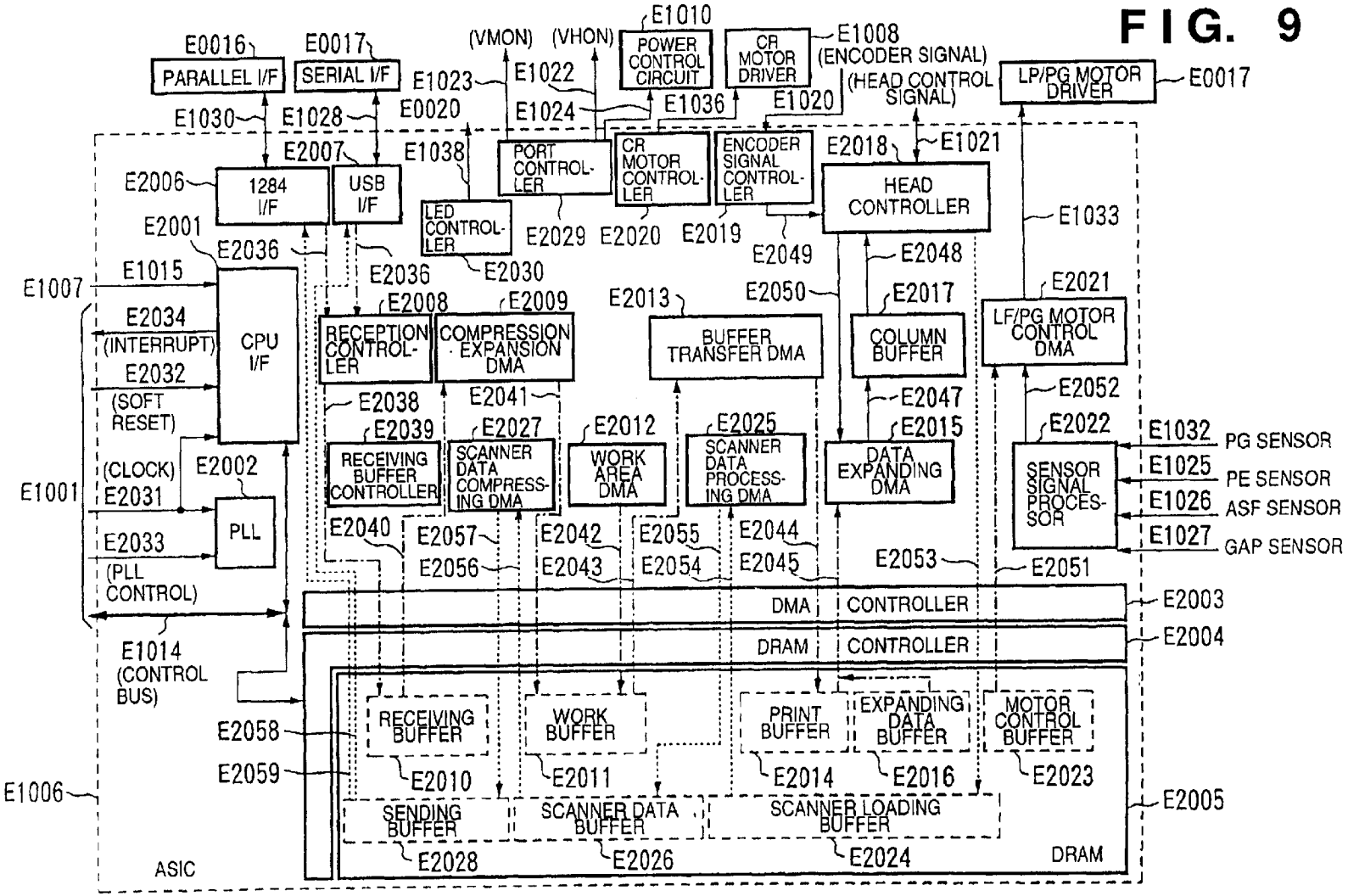
FIG. 9 is a block diagram showing the internal arrangement of an ASIC shown in FIG. 8.

FIG. 9 is a block diagram showing the internal arrangement of the ASIC E1006.

Referring to FIG. 9, only flows of data, such as printing data and motor control data, pertaining to control of the head and each mechanical part are shown in connections between individual blocks. Control signals and clocks concerning read and write of a built-in register in each block and control signals related to DMA control are omitted to avoid the complexity of description in the drawing.

As shown in FIG. 9, a PLL E2002 generates a clock (not shown) to be supplied to the most part of the ASIC E1006, in accordance with a clock signal (CLK) E2031 and PLL control signal (PLLON) E2033 output from the CPU E1001.

A CPU interface (CPU I/F) E2001 controls read and write to a register in each block (to be described below), supplies clocks to some blocks, and accepts an interrupt signal (none of these functions is shown), in accordance with the reset signal E1015, a soft reset signal (PDWN) E2032 and the clock signal (CLK) E2031 output from the CPU E1001, and a control signal from the control bus E1014. This CPU I/F E2001 outputs an interrupt signal (INT) E2034 to the CPU E1001 to inform the CPU E1001 of generating an interrupt in the ASIC E1006.

A DRAM E2005 has areas such as a receiving buffer E2010, work buffer E2011, print buffer E2014, and expanding data buffer E2016, as printing data buffers, and also has a motor control buffer E2023 for motor control. In addition to these printing data buffers, the DRAM E2005 has areas such as a scanner loading buffer E2024, scanner data buffer E2026, and sending buffer E2028, as buffers for use in a scanner operation mode.

This DRAM E2005 is also used as a work area necessary for the operation of the CPU E1001. That is, a DRAM controller E2004 switches between access from the CPU E1001 to the DRAM E2005 using the control bus and access from a DMA controller E2003 (to be described below) to the DRAM E2005, thereby performing read and write to the DRAM E2005.

The DMA controller E2003 accepts a request (not shown) from each block and outputs, to the RAM controller, an address signal and a control signal (neither is shown), or write data (E2038, E2041, E2044, E2053, E2055, or E2057) when a write operation is to be performed, thereby performing DRAM access. When a read operation is to be performed, the DMA controller E2003 transfers readout data (E2040, E2043, E2045, E2051, E2054, E2056, E2058, or E2059) from the DRAM controller E2004 to the block which has requested.

A 1284 I/F E2006 interfaces by two-way communication with an external host apparatus (not shown) through the parallel I/F E0016 under the control of the CPU E1001 via the CPU I/F E2001. Also, when printing is to be performed, the 1284 I/F E2006 transfers received data (PIF received data E2036) from the parallel I/F E0016 to a reception controller E2008 by DMA processing. When scanner read is to be performed, the 1284 I/F E2006 transmits data (1284 transmission data (RDPIF) E2059) stored in the sending buffer E2028 in the DRAM E2005 to the parallel I/F by DMA processing.

A USB I/F E2007 interfaces by two-way communication with an external host apparatus (not shown) through the serial I/F E0017 under the control of the CPU E1001 via the CPU I/F E2001. Also, when printing is to be performed, the USB I/F E2007 transfers received data (USB received data E2037) from the serial I/F E0017 to the reception controller E2008 by OMA processing. When scanner read is to be performed, the USB I/F E2007 transmits data (USB transmission data (RDPIF) E2058) stored in the sending buffer E2028 in the DRAM E2005 to the serial I/F by DMA processing. The reception controller E2008 writes received data (WDIF) E2038) from a selected one of the 1284 I/F E2006 and the USB I/F E2007 into a receiving buffer write address managed by a receiving buffer controller E2039.

A compression expansion DMA E2009 reads out, under the control of the CPU E1001 via the CPU I/F E2001, received data (raster data) stored on the receiving buffer E2010 from a receiving buffer read address managed by the receiving buffer controller E2039, compresses or expands readout data (RDWK) E2040 in accordance with a designated mode, and writes the data as a printing code string (WDWK) E2041 in the work buffer area.

A printing buffer transfer DMA E2013 reads out, under the control of the CPU E1001 via the CPU I/F E2001, printing codes (RDWP) E2043 on the work buffer E2011, rearranges each printing code into an address on the print buffer E2014, which is suitable for the order of data transfer to the printhead cartridge H1000, and transfers the code (WDWP E2044). A work clear DMA E2012 repeatedly transfers and writes, under the control of the CPU E1001 via the CPU I/F E2001, designated work file data (WDWF) E2042 in a region on the work buffer to which the data is completely transferred by the printing buffer transfer DMA E2015.

A printing data expanding DMA E2015 reads out, under the control of the CPU E1001 via the CPU I/F E2001, the printing codes rearranged and written on the print buffer and expanding data written on the expanding data buffer E2016, by using a data expansion timing signal E2050 from a head controller E2018 as a trigger, thereby generating expanded printing data (WDHDG) E2045, and writes the generated data as column buffer write data (WDHDG) E2047 in a column buffer E2017. This column buffer E2017 is an SRAM for temporarily storing data (expanded printing data) to be transferred to the printhead cartridge H1000. The column buffer E2017 is shared and managed by the printing data expanding DMA and the head controller in accordance with a handshake signal (not shown) of these two blocks.

Under the control of the CPU E1001 via the CPU I/F E2001, this head controller E2018 interfaces with the printhead cartridge H1000 or the scanner via a head control signal. In addition, on the basis of a head driving timing signal E2049 from an encoder signal processor E2019, the head controller E2018 outputs a data expansion timing signal E2050 to the printing data expanding DMA.

When printing is to be performed, the head controller E2018 reads out expanded printing data (RDHD) E2048 from the column buffer in accordance with the head driving timing signal E2049. The head controller E2018 outputs the readout data to the printhead cartridge H1000 via the head control signal E1021.

In a scanner read mode, the head controller E2018 transfers loaded data (WDHD) E2053 input via the head control signal E1021 to the scanner loading buffer E2024 on the DRAM E2005 by DMA transfer. A scanner data processing DMA E2025 reads out, under the control of the CPU E1001 via the CPU I/F E2001, loading buffer readout data (RDAV) E2054 stored in the scanner loading buffer E2024 into a scanner data buffer E2026 on the DRAM E2005 and writes processed data (WDAV) E2055, subjected to processing such as averaging, into the scanner data buffer E2016 on the DRAM E2005.

A scanner data compressing DMA E2027 reads out processed data (RDYC) E2056 on the scanner data buffer E2026, compresses the data, and writes compressed data (WDYC) E2057 in the sending buffer E2028, under the control of the CPU E1001 via the CPU I/F E2001.

The encoder signal processor E2019 receives an encoder signal (ENC) and outputs the head driving timing signal E2049 in accordance with a mode determined by the control of the CPU E1001. In addition, the encoder signal processor E2019 stores information concerning the position or speed of the carriage M4001, obtained from the encoder signal E1020, into a register and provides the information to the CPU E1001. On the basis of this information, the CPU E1001 determines various parameters for controlling the CR motor E0001. A CR motor controller E2020 outputs a CR motor control signal E1036 under the control of the CPU E1001 via the CPU I/F E2001.

A sensor signal processor E2022 receives output sensing signals from, e.g., the PG sensor E0010, the PE sensor E0007, the ASF sensor E0009, and the GAP sensor E0008, and transmits these pieces of sensor information to the CPU E1001 in accordance with a mode determined by the control of the CPU E1001. The sensor signal processor E2022 also outputs a sensor signal E2052 to an LF/PG motor control DMA E2021.

Under the control of the CPU E1001 via the CPU I/F E2001, this LF/PG motor control DMA E2021 reads out a pulse motor driving table (RDPM) E2051 from a motor control buffer E2023 on the DRAM E2005 and outputs a pulse motor control signal E. In addition, the LF/PG motor control DMA E2021 outputs a pulse motor control signal E1033 by using the abovementioned sensor signal as a trigger of the control.

An LED controller E2030 outputs an LED driving signal E1038 under the control of the CPU E1001 via the CPU I/F E2001. A port controller E2029 outputs the head power ON signal E1022, the motor power ON signal E1023, and the power control signal E1024 under the control of the CPU E1001 via the CPU I/F E2001.

Figure 10:
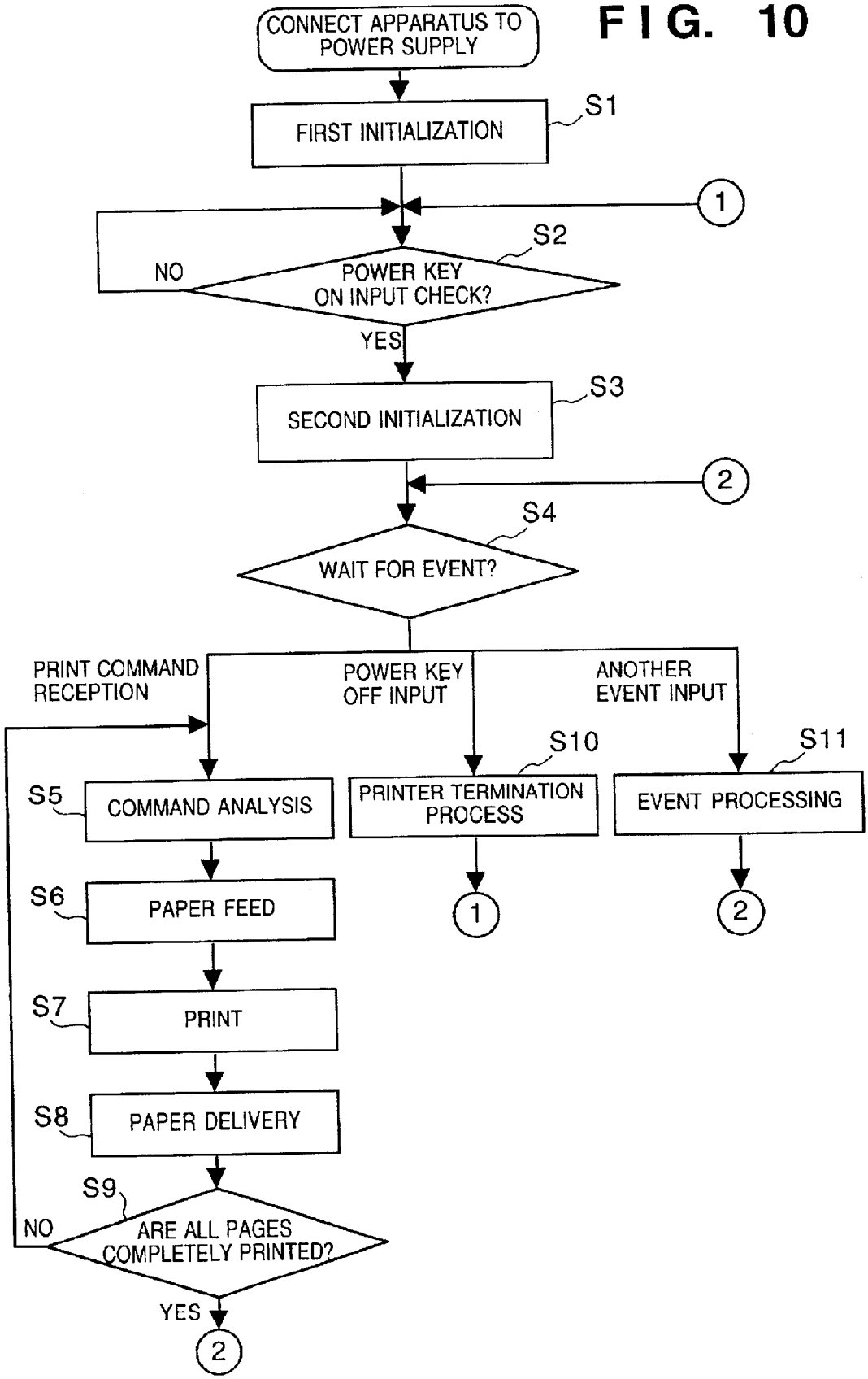
FIG. 10 is a flow chart showing the operation of the embodiment of the present invention.

The operation of the inkjet printing apparatus of this embodiment of the present invention constructed as above will be described below with reference to a flow chart in FIG. 10.

When this apparatus is connected to the AC power supply, in step S1 first initialization is performed for the apparatus. In this initialization, the electric circuit system including, e.g., the ROM and RAM of this apparatus is checked, thereby checking whether the apparatus can normally operate electrically.

In step S2, whether the power key E0018 on the upper case M1002 of the apparatus main body M1000 is pressed is checked. If the power key E0018 is pressed, the flow advances to step S3 to perform second initialization.

In this second initialization, the various driving mechanisms and the head system of this apparatus are checked. That is, whether the apparatus is normally operable is checked in initializing the various motors and loading head information.

In step S4, an event is waited for. That is, a command event from the external I/F, a panel key event by a user operation, or an internal control event with respect to this apparatus is monitored. If any of these events occurs, processing corresponding to the event is executed.

For example, if a printing command event is received from the external I/F in step S4, the flow advances to step S5. If a power key event by a user operation occurs in step S4, the flow advances to step S10. If another event occurs in step S4, the flow advances to step S11.

In step S5, the printing command from the external I/F is analyzed to determine the designated paper type, sheet size, printing quality, and paper feed method. Data indicating these determination results is stored in the RAM E2005 of the apparatus, and the flow advances to step S6.

In step S6, paper feed is started by the paper feed method designated in step S5. When the sheet is fed to a printing start position, the flow advances to step S7.

In step S7, printing is performed. In this printing, printing data supplied from the external I/F is once stored in the printing buffer. Subsequently, the CR motor E0001 is driven to start moving the carriage M4001 in the scanning direction, and the printing data stored in the print buffer E2014 is supplied to the printhead cartridge H1000 to print one line. When the printing data of one line is completely printed, the LF motor E0002 is driven to rotate an LF roller M3001 to feed the sheet in the sub-scan direction. After that, the above operation is repeatedly executed. When printing of the printing data of one page supplied from the external I/F is completed, the flow advances to step S8.

In step S8, the LF motor E0002 is driven to drive a sheet delivery roller M2003. Sheet feed is repeated until it is determined that the sheet is completely delivered from this apparatus. When this operation is completed, the sheet is completely delivered onto the sheet delivery tray M1004*a*.

In step S9, whether printing of all pages to be printed is completed is checked. If pages to be printed remain, the flow returns to step S5 to repeat the operation in steps S5 to S9 described above. When printing of all pages to be printed is completed, the printing operation is completed. After that, the flow returns to step S4 to wait for the next event.

In step S10, a printer termination process is performed to stop the operation of this apparatus. That is, to shut off the power supply to the various motors and the head, the operation transits to a state in which the power supply can be shut off. After that, the power supply is shut off, and the flow returns to step S4 to wait for the next event.

In step S11, event processing other than the above is performed. For example, processing corresponding to any of the diverse panel keys of this apparatus, a recovery command from the external I/F, or an internally occurring recovery event is performed. After the processing, the flow advances to step S4 to wait for the next event.

[First Embodiment]

Summary of Head Control

Common ink discharge is performed by ANDing printing data and a heat pulse. Printing data determines the presence/absence of printing. A heat pulse involves the control of discharge energy. Also, driving all dischargeable nozzles at the same time excessively increases the required electric power, generated heat amount, and ink supply amount. Therefore, discharge nozzles are usually separately driven.

First, a discharge nozzle driving circuit and driving timings of the first embodiment will be described below with reference to FIGS. 11 and 12.

Figure 11:
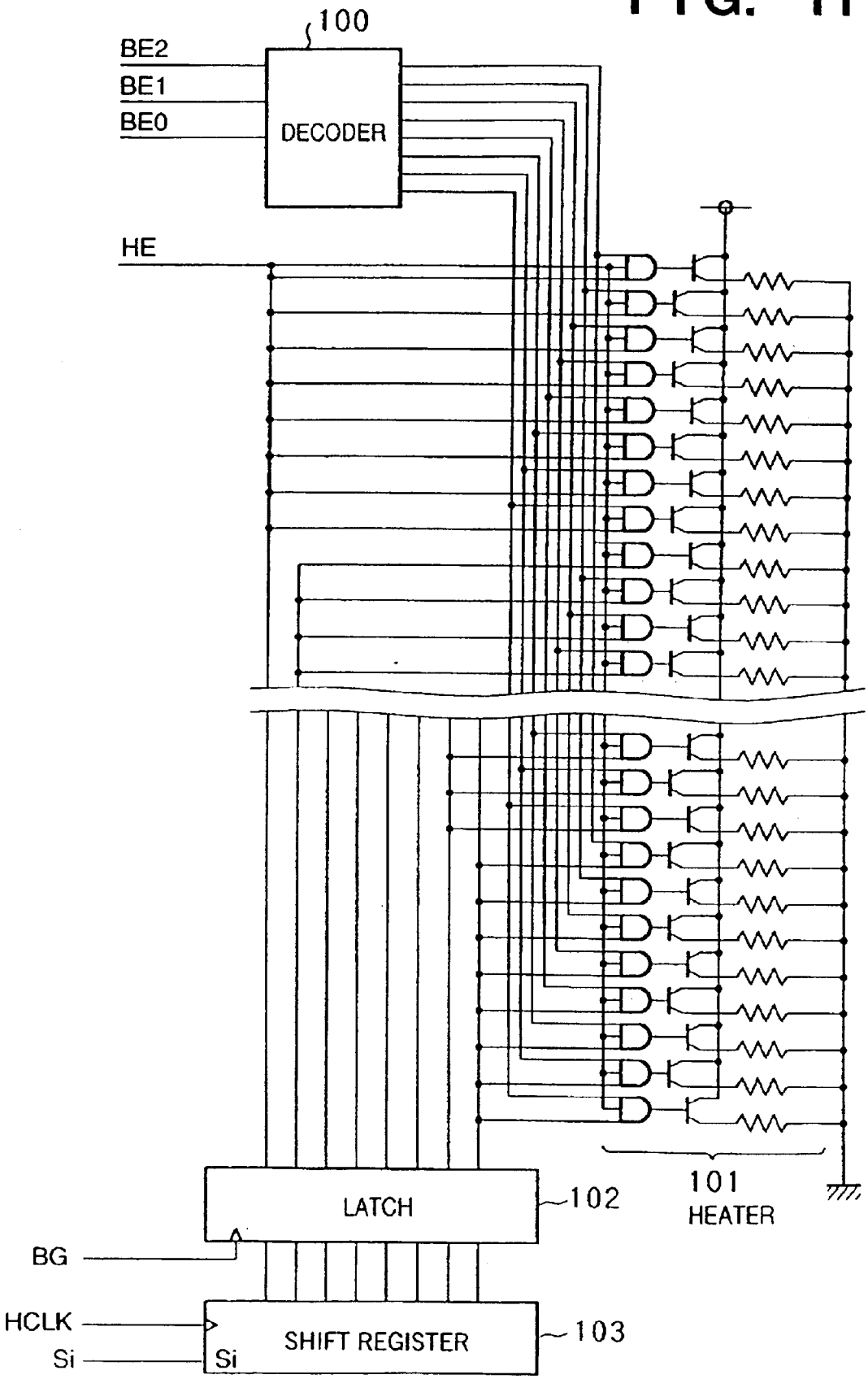
FIG. 11 is a view showing a discharge nozzle driving circuit of the first embodiment.
Figure 12:
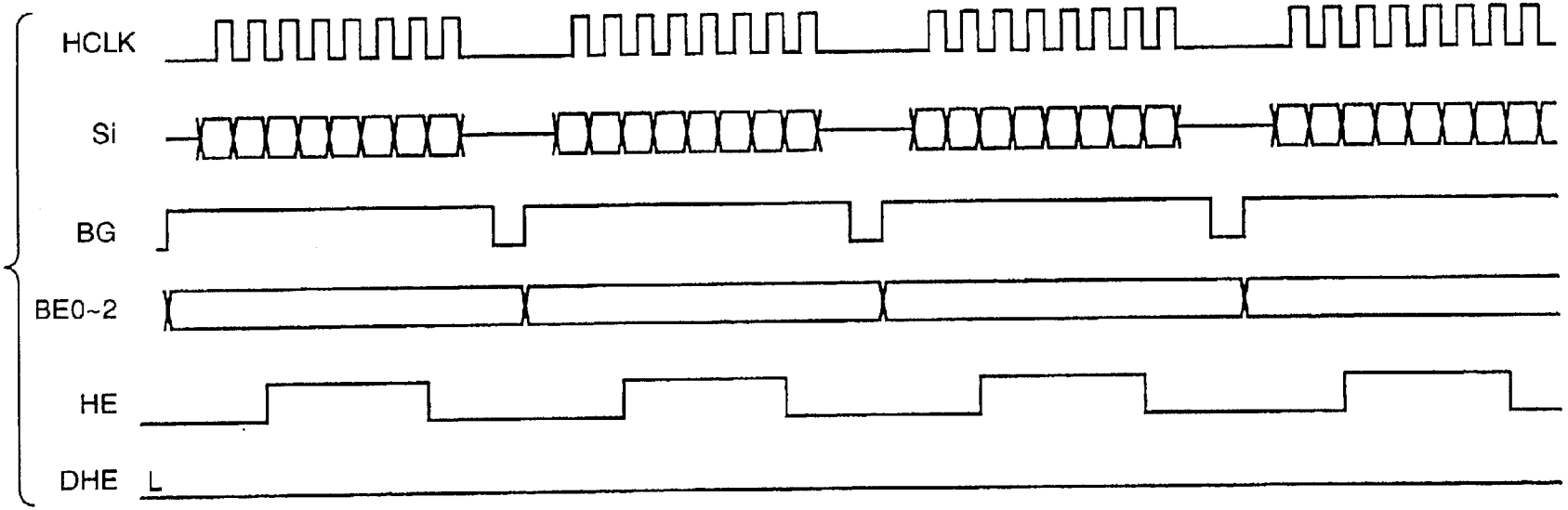
FIG. 12 is a timing chart showing the driving timings of the discharge nozzle driving circuit of the first embodiment shown in FIG. 11.

FIG. 11 is a view showing the discharge nozzle driving circuit of the first embodiment. FIG. 12 is a timing chart showing the driving timings of this discharge nozzle driving circuit shown in FIG. 11.

FIG. 11 shows a printhead having sixty-four nozzles divided into eight portions by an 8-bit shift register 103 and three block division signals. Each heater 101 is driven by a transistor. When this heater 101 is heated, film boiling occurs in ink, so the ink can be discharged.

Printing data is serially transferred to the shift register 103 by using an HCLK signal and an Si signal and latched by a latch 102 by using a BG signal. A decoder 100 decodes three block division signals, i.e., signals BE0, BE1, BE2 into eight signals which are enable signals (block designation signals) of the heater 101 divided into eight portions. Discharge is controlled by ANDing a printing data signal, a selected block designation signal, and a heat pulse signal HE.

A power supply path in a general inkjet printing apparatus will be described below with reference to FIG. 13.

Figure 13:
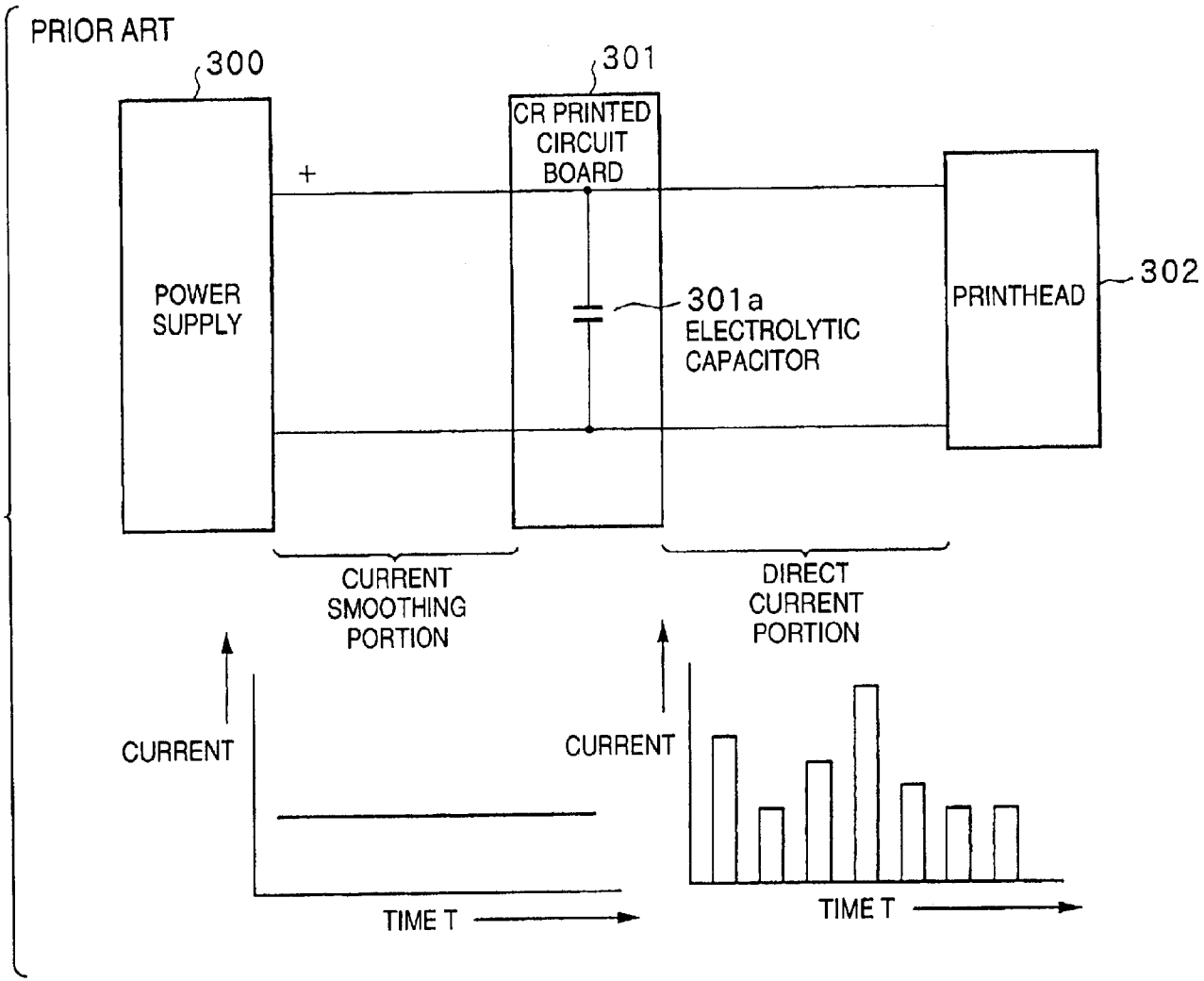
FIG. 13 is a view showing a power supply path of a general inkjet printing apparatus.

FIG. 13 is a view showing a power supply path of a general inkjet printing apparatus.

An electric current supplied in the form of a pulse to a heater of a printhead 302 is smoothed by an electrolytic capacitor 301*a* on a CR printed circuit board 301. Accordingly, although the electric current for driving the printhead 302 causes voltage drop by an intermediate wiring resistance, this current functions as a pulse current from the CR printed circuit board 301 to the printhead 302 and functions as a smoothed current from the CR printed circuit board 301 to a main power supply 300, thereby causing an intermediate voltage drop.

Figure 14:
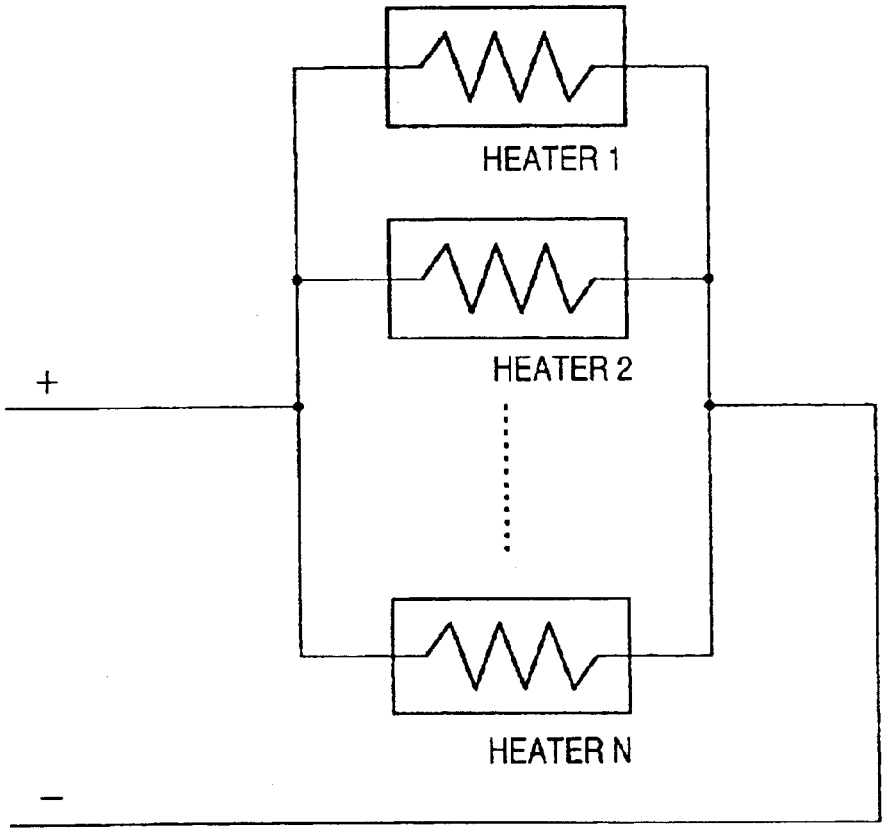
FIG. 14 is a view showing a power supply path when the number of simultaneous ink discharging nozzles is N.

When this voltage drop occurs, a pulse width must be increased to supply the same energy to the heater. Assume that a printing apparatus has a common power supply system and mounts a printhead having 64 nozzles per chip×4 colors. When this printhead is driven by dividing one chip into eight blocks, the number of simultaneous ink discharging nozzles as a whole is 0 to 32 (8 dots/chip×4 chips). Assume that the number of simultaneous ink discharging nozzles is uniform with respect to the nozzle positions in each chip and is also uniform timewise. In this case, if the number of simultaneous ink discharging nozzles is N, a power supply circuit is schematically considered as a parallel circuit of heater resistances as shown in FIG. 14.

In this circuit, a wiring resistance for each of these heaters 1 to N in the printhead varies in accordance with the distance from an electrode of the printhead to the heater. To prevent this, it is desirable to design wiring in the printhead by adjusting the wiring width such that the wiring resistances for the heaters are the same.

Figure 15:
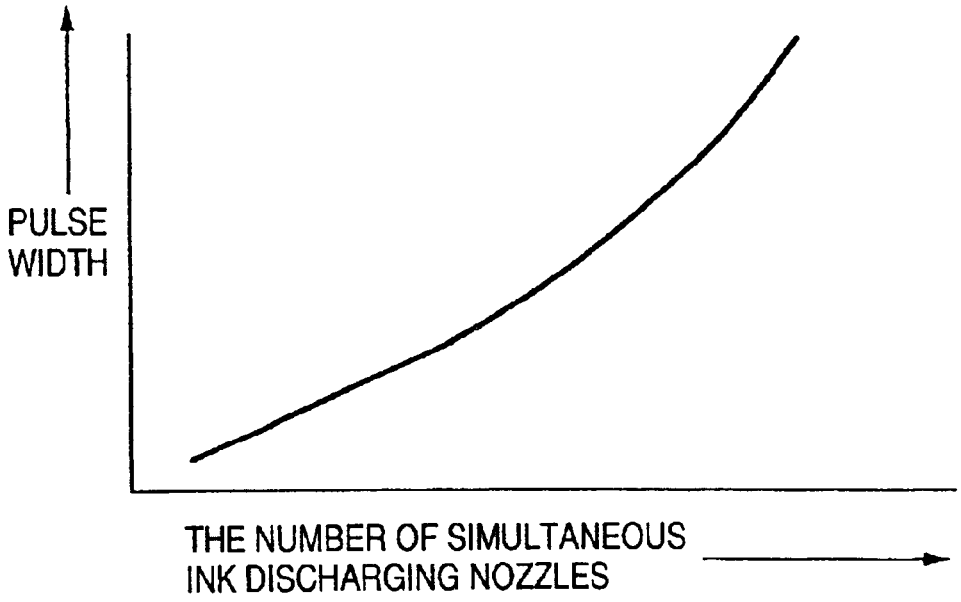
FIG. 15 is a graph showing the relationship between the number of simultaneous ink discharging nozzles and the pulse width.

When the voltage drop caused by simultaneous discharge is compensated for by the driving pulse width as described above, the relationship between the number of simultaneous ink discharging nozzles and the driving pulse width is represented as in FIG. 15.

An unknown driving pulse width table for determining the driving pulse width, which table has been examined prior to the present invention, has determined a driving pulse width by the various driving conditions (heater resistance and driving transistor resistance (TrON resistance)) of the printhead, the wiring resistances, and the environmental temperature. For example, FIG. 16 shows a driving pulse width table when the heater resistance and the TrON resistance are divided into eight ranks and the environmental temperature is divided into five ranks from 20° C. or less to 50° C. or more.

In this table, the influence of the voltage drop by the number of simultaneous ink discharging nozzles is neglected. Hence, the driving pulse width is so set as to compensate for ink discharge when the number of simultaneous ink discharging nozzles is a maximum. This increases the design load for minimizing the voltage drop. Especially when the number of simultaneous ink discharging nozzles is small, excess energy is applied to the heater, and this adversely affects the durability of the printhead. By contrast, FIG. 17 shows an unknown driving pulse width table including the number of simultaneous ink discharging nozzles.

This method can avoid supplying excess energy when the number of simultaneous ink discharging nozzles is small. However, the method requires heater ranks (8 ranks)×TrON ranks (8 ranks)×environmental temperature ranks (5 ranks)= 320 driving pulse width tables. Consequently, a large memory area in a memory for storing the driving pulse width tables is consumed.

In the first embodiment, therefore, driving pulse width tables as shown in FIGS. 18 to 20 are formed. First, a driving pulse No. is determined in accordance with the printhead driving conditions. In this embodiment, the driving pulse for the printhead is determined (FIG. 18) a driving condition using the environmental temperature in addition to the printhead characteristics such as the heater rank and TrON rank, and a fundamental pulse width for driving is determined (FIG. 19). In this case, the environmental temperature may be a head temperature obtained from a temperature sensor arranged on a head constituent member such as a printing element board, or a head temperature estimated using a temperature sensor arranged outside the head. Subsequently, on the basis of this driving pulse No., a driving pulse width table (FIG. 20) for correcting the voltage drop by the number of simultaneous ink discharging nozzles is determined. Accordingly, pulses having the same fundamental pulse width and equal pulse width compensation amounts based on the number of simultaneous ink discharging nozzles have the same driving pulse No. serving as an index No. This makes it possible to design a small driving pulse width table as shown in FIG. 20 by avoiding unnecessary duplication. Also, pulses having the same fundamental pulse width and different pulse width compensation amounts are assigned different driving pulse Nos., such as driving pulse Nos. 15 and 16.

A method of discriminating the number of simultaneous ink discharging nozzles (the number of simultaneously driven heaters) in real time will be described below with reference to FIG. 21.

Figure 21:
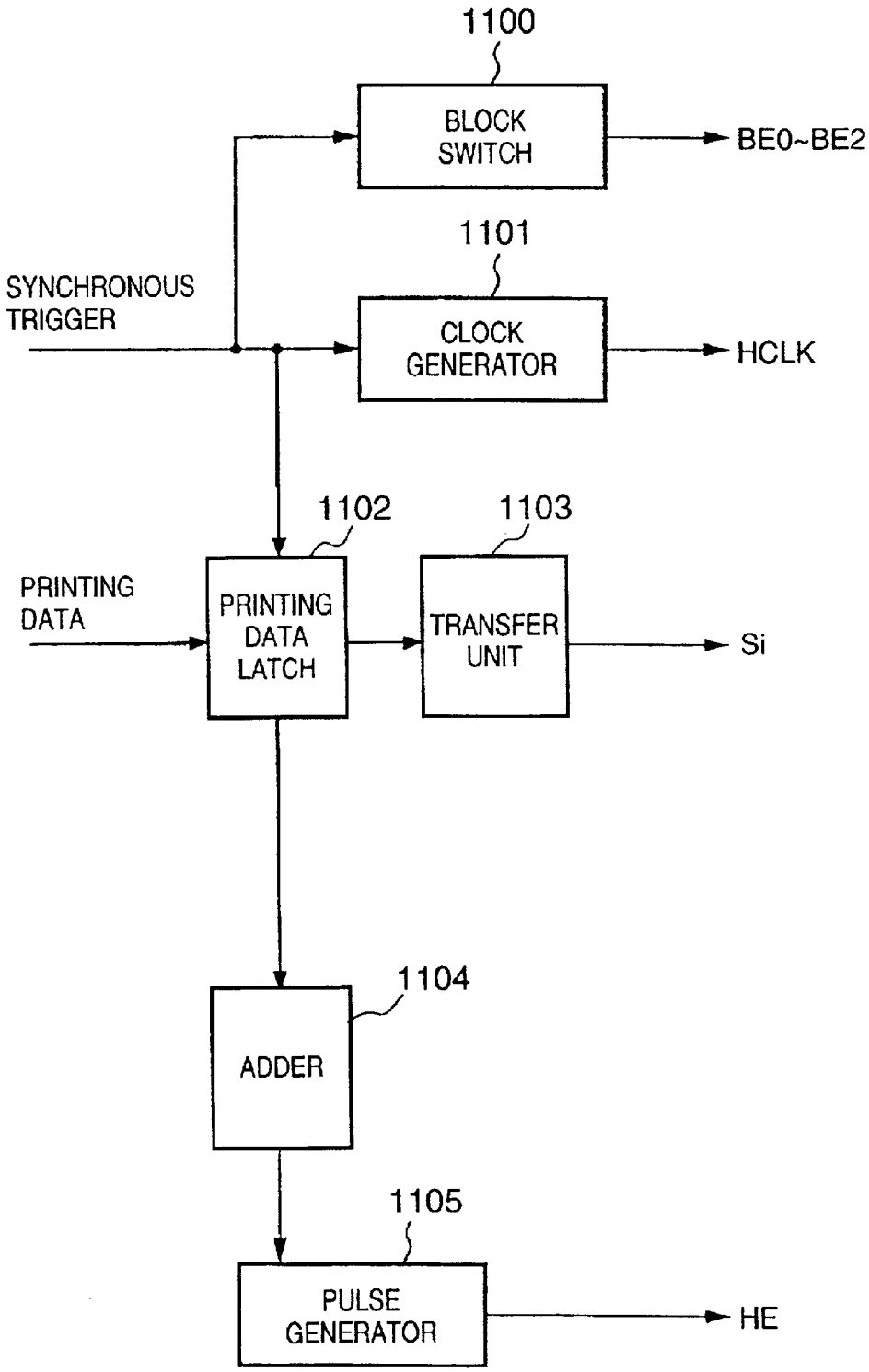
FIG. 21 is a block diagram of a driving signal generating circuit of the first embodiment.
Figure 22:
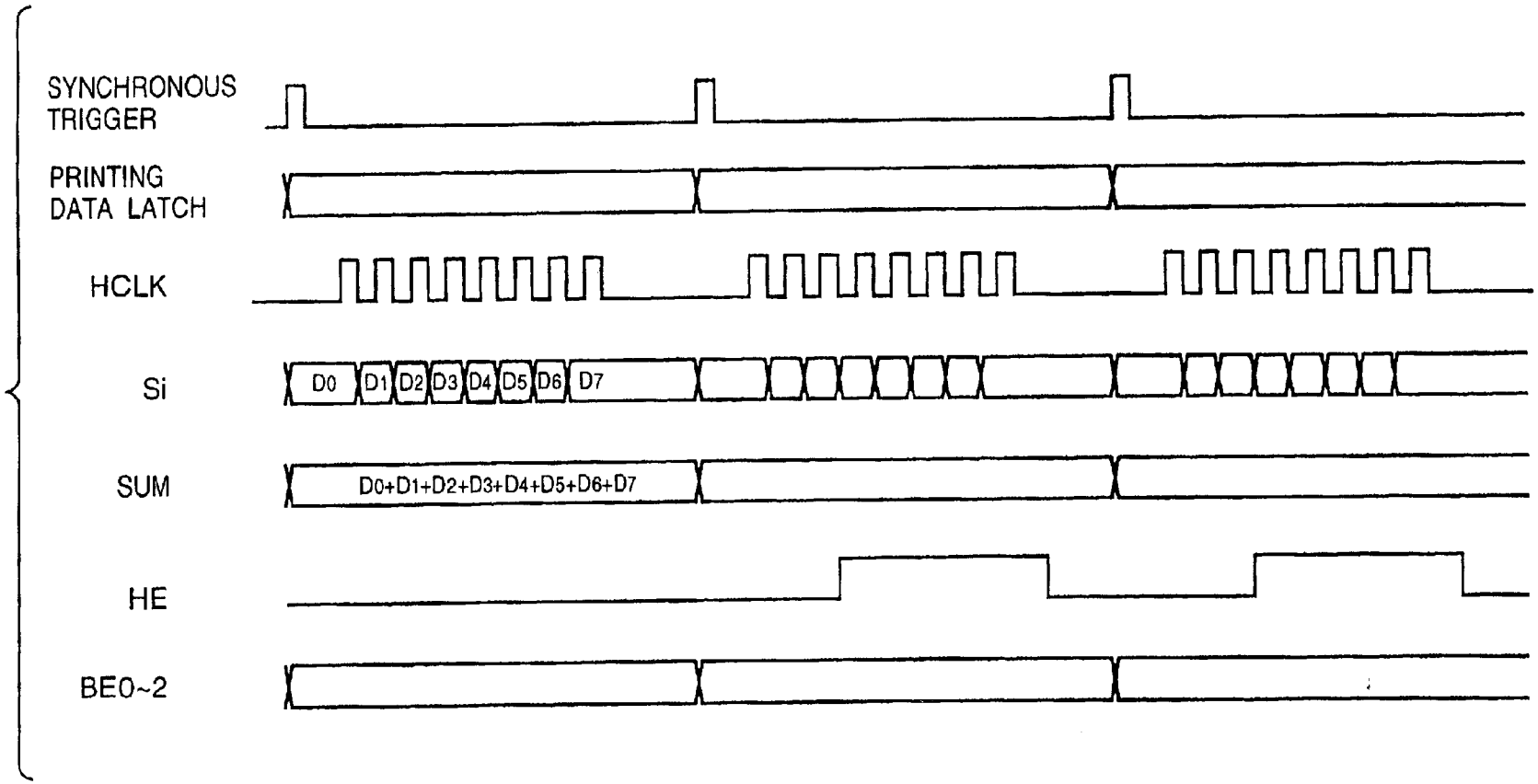
FIG. 22 is a timing chart showing the driving timings of the driving signal generating circuit of the first embodiment.

FIG. 21 is a block diagram of a driving signal generating circuit of the first embodiment. FIG. 22 is a timing chart showing the driving timings of this driving signal generating circuit shown in FIG. 21.

Assuming one block period is a basis, printing data is transferred in one block period, and nozzles corresponding to the transferred printing data are driven in the next period. Therefore, FIG. 21 will be described on the basis of a synchronous trigger.

When a synchronous trigger is input, printing data to be transferred is loaded from a printing buffer and latched in a printing data latch 1102. At the same time, a block switch 1100 switches block signals, and a clock signal generator 1101 generates a clock HCLK signal for transferring the latched printing data to the printhead. More specifically, the number of bits of the latched printing data is added. If the block period has a margin, an easy addition method is to enable the printing data and count up a counter by the HCLK signal. If there is no time margin, it is also possible to add all bits by an adder and completely discriminate the number of simultaneous ink discharging nozzles while the printing data is transferred.

A pulse generator 1105 outputs a heat pulse signal HE by modulating the pulse width. One example of the pulse width modulation method is to store the driving pulse width table shown in FIG. 20 into a RAM, read out a modulation amount requiring the number of simultaneous ink discharging nozzles as an address from the driving pulse width table, and use the readout modulation amount in pulse width modulation. In this pulse width modulation, a necessary pulse width can be obtained by outputting H after an elapse of a time designated by the synchronous trigger, and outputting L after an elapse of a designated time, in this example, a time read out from the driving pulse width table.

Figure 23:
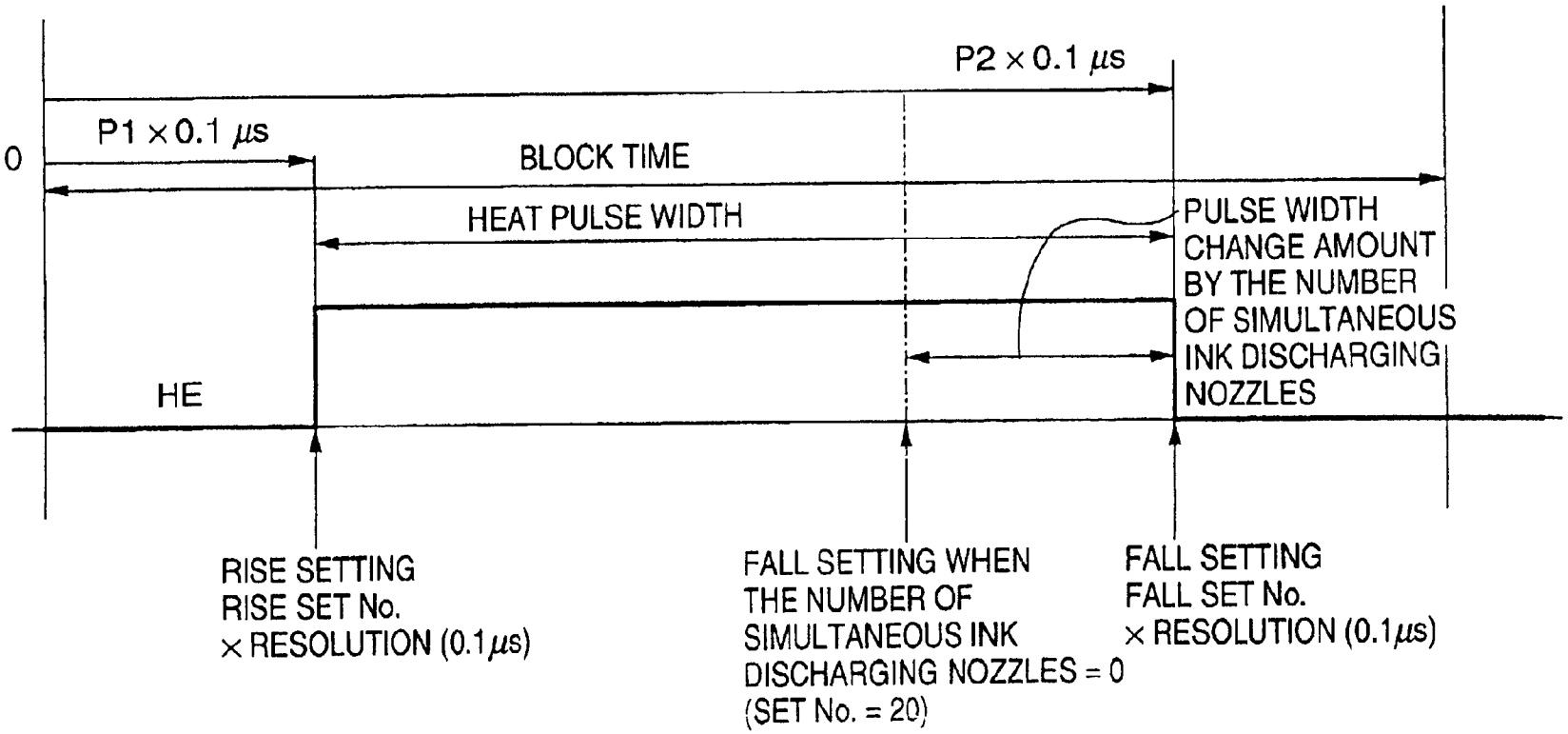
FIG. 23 is a view showing an example of a driving pulse setting method of the first embodiment.

In this example, the fundamental pulse for driving is generated using the printhead characteristics such as the heater rank and TrON rank. However, the fundamental pulse may be generated using either the heater rank or the TrON rank. Alternatively, this fundamental pulse may be generated in consideration of wiring resistances and manufacturing errors in, e.g., heater surface-heater size. The generated printhead fundamental driving pulse can be measured and written as a head ROM set No. in a storage means, e.g., an EEPROM of the printhead, so as to be used as a means for obtaining a driving pulse No. instead of the head characteristics such as heater rank.TrON rank. Furthermore, as shown in FIG. 23, it is possible to form a driving pulse width table which manages the rise time and fall time of the heat pulse signal HE, while the fall time of a fundamental pulse is fixed. In this example, the block start time is 0, and the rise.fall set No. which is an integral multiple of the pulse resolution is described. This eliminates the trouble to calculate the rise time and fall time from the driving pulse width table. FIGS. 24 to 28 show the arrangements of driving pulse width tables in this case.

Processing executed in the first embodiment will be described below with reference to FIG. 29.

Figure 29:
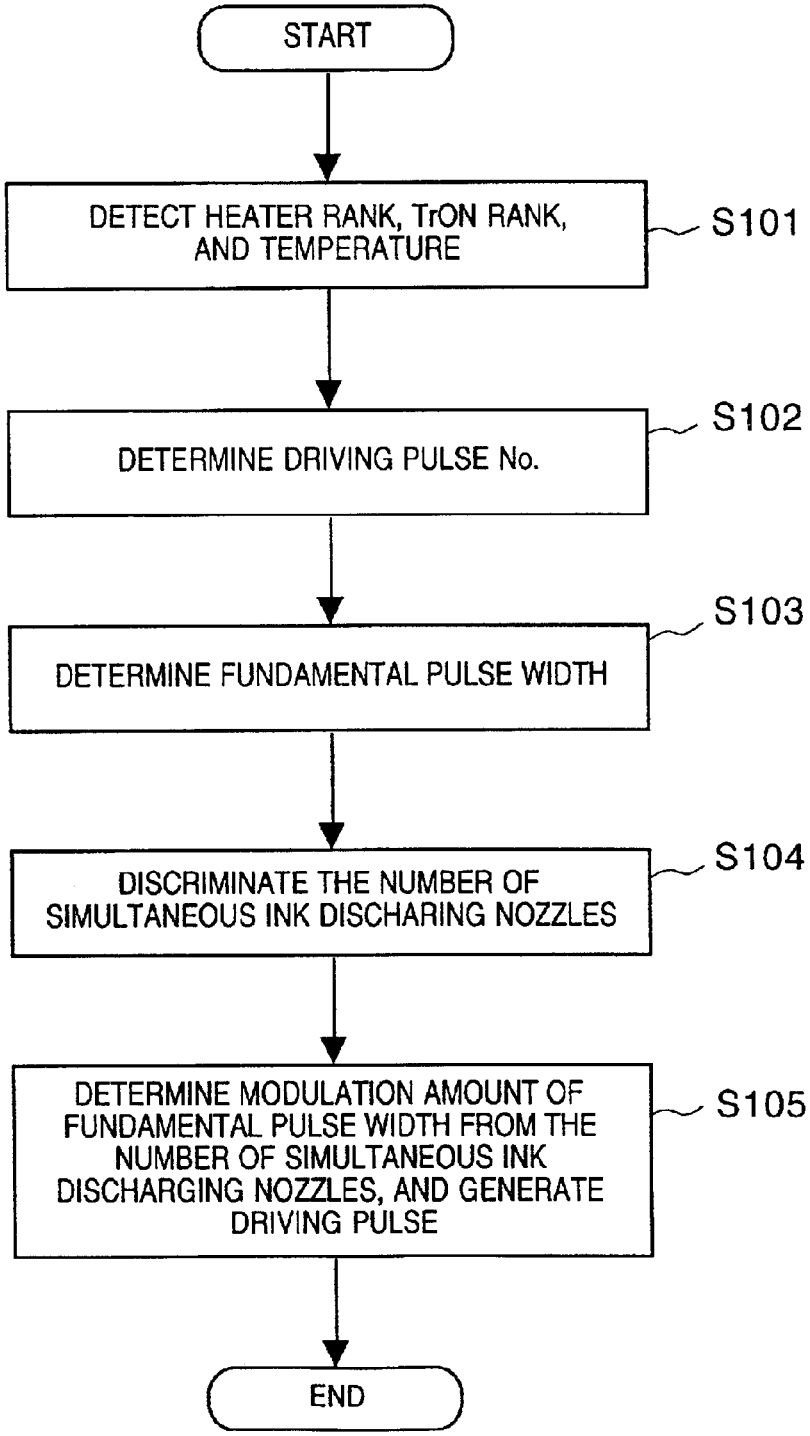
FIG. 29 is a flow chart showing processing executed in the first embodiment.

FIG. 29 is a flow chart showing the processing executed in the first embodiment.

In processing of the flow chart, steps S101 to S103 are executed before printing or if a time margin is sufficient during line return or the like, while steps S104 and S105 are executed during printing (head driving).

In step S101, a heater rank and TrON rank serving as the printhead characteristics, and environmental temperature are detected. In step S102, on the basis of the detected heater rank, TrON rank, and environmental temperature, a driving pulse No. is determined by referring to the table shown in FIG. 18. In step S103, a fundamental pulse width corresponding to the determined driving pulse No. is determined by referring to the table shown in FIG. 19. In step S104, the number of simultaneous ink discharging nozzles of the printhead to be processed is discriminated. In step S105, a modulation amount of the fundamental pulse width, which corresponds to the discriminated number of simultaneous ink discharging nozzles, is determined by referring to the table shown in FIG. 20, and the fundamental pulse width is modulated by this modulation amount to generate a driving pulse.

Note that the above processing is realized by the aforementioned main PCB (E0014) shown in FIG. 8 by controlling the individual components shown in FIG. 21 by referring to the driving pulse width tables shown in FIGS. 18 to 20.

In the first embodiment as described above, the fundamental pulse width is determined by the driving conditions such as the printhead characteristics and environmental temperature. After that, the driving pulse width is determined by the number of simultaneous ink discharging nozzles and the fundamental pulse width. Accordingly, pulse width control for correcting the voltage drop caused by an increase in the number of simultaneous ink discharging nozzles can be appropriately performed even when the pulse width changes with temperature change. Also, it is possible to prevent printing density unevenness and landing errors caused by temperature change and at the same time improve the durability by performing pulse width control based on the number of simultaneous ink discharging nozzles.

In the first embodiment, to improve both the discharge stability and the heater durability, a reduction in the input energy to the heater caused by the voltage drop due to the number of simultaneous ink discharging nozzles is compensated for by the pulse width. However, this first embodiment is similarly applicable to a case in which a short pulse for holding the temperature, not for discharging ink, is input.

[Second Embodiment]

In the second embodiment, control of the driving pulse width in an inkjet printing apparatus having a plurality of printheads will be described.

In this embodiment, assume that the number of printheads is two.

A power supply path of an inkjet printing apparatus in which a power supply system is divided into two parts and power is separately supplied to two printheads will be described below with reference to FIG. 30.

Figure 30:
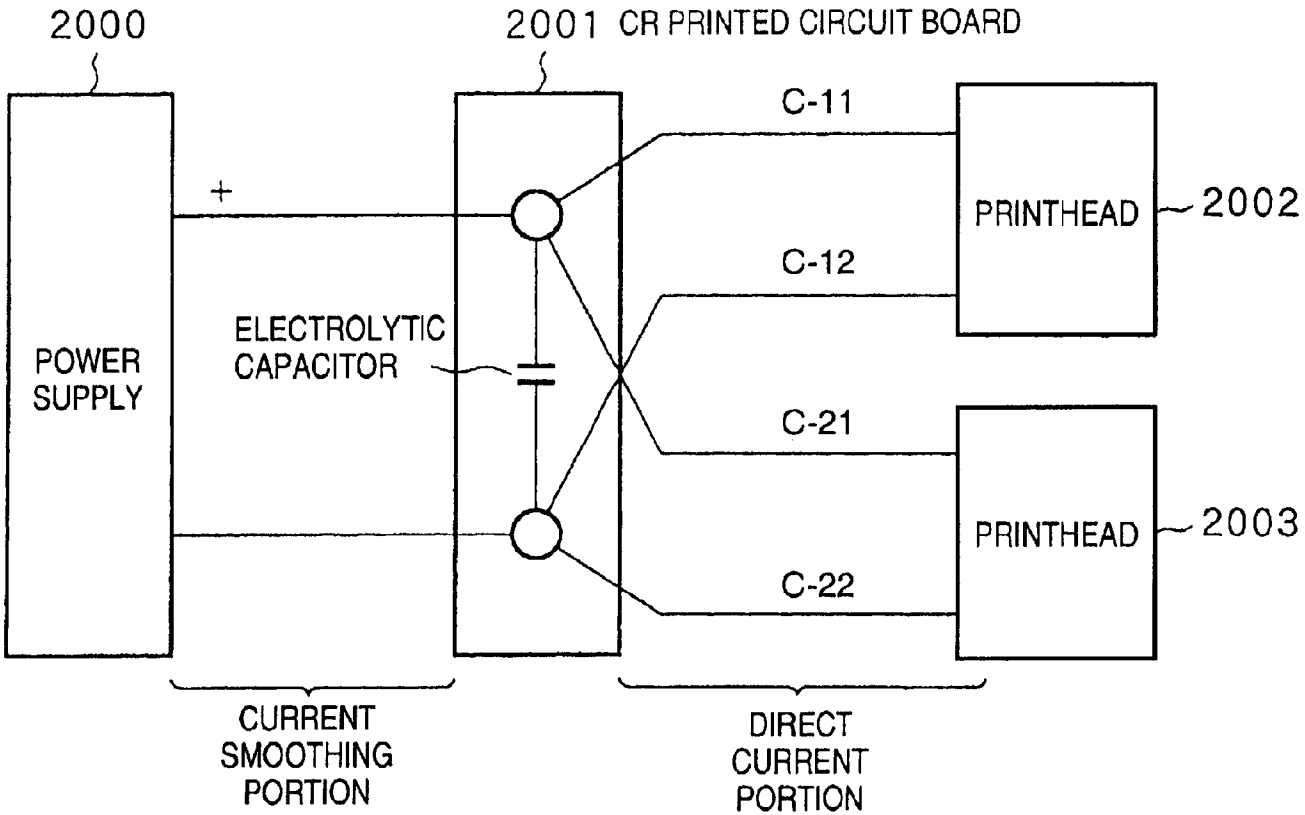
FIG. 30 is a view showing a power supply path of an inkjet printing apparatus of the second embodiment.

FIG. 30 is a view showing a power supply path of the inkjet printing apparatus of the second embodiment.

In this apparatus, three numbers of simultaneous ink discharging nozzles exist: the number S1 of simultaneous ink discharging nozzles for a printhead 2002, the number S2 of simultaneous ink discharging nozzles for a printhead 2003, and the total number S3 (=S1+S2) of simultaneous ink discharging nozzles. Particularly, a voltage drop with respect to the printhead 2002 is affected by the resistances of C-11 and C-12, the number S1 of simultaneous ink discharging nozzles, the resistance of a current smoothing portion, and the total number S3 of simultaneous ink discharging nozzles. Driving pulse width control taking account of all these factors is complicated. Therefore, the resistance value of the current smoothing portion is designed to be low, and the number of simultaneous ink discharging nozzles of each power supply system is counted assuming that the degree of a voltage drop (by the resistances of C-11 and C-12 and the number S1 of simultaneous ink discharging nozzles) primarily caused by a pulse current is large. In this manner, a driving pulse width for compensating for voltage drops in the lines C-11 and C-12 caused by simultaneous discharge is determined. If the two power supply systems are different in, e.g., head driving voltage, number of nozzles, discharge amount, or driving pulse width, preparing different driving pulse width tables for these systems makes the present invention adaptable.

Figure 31:
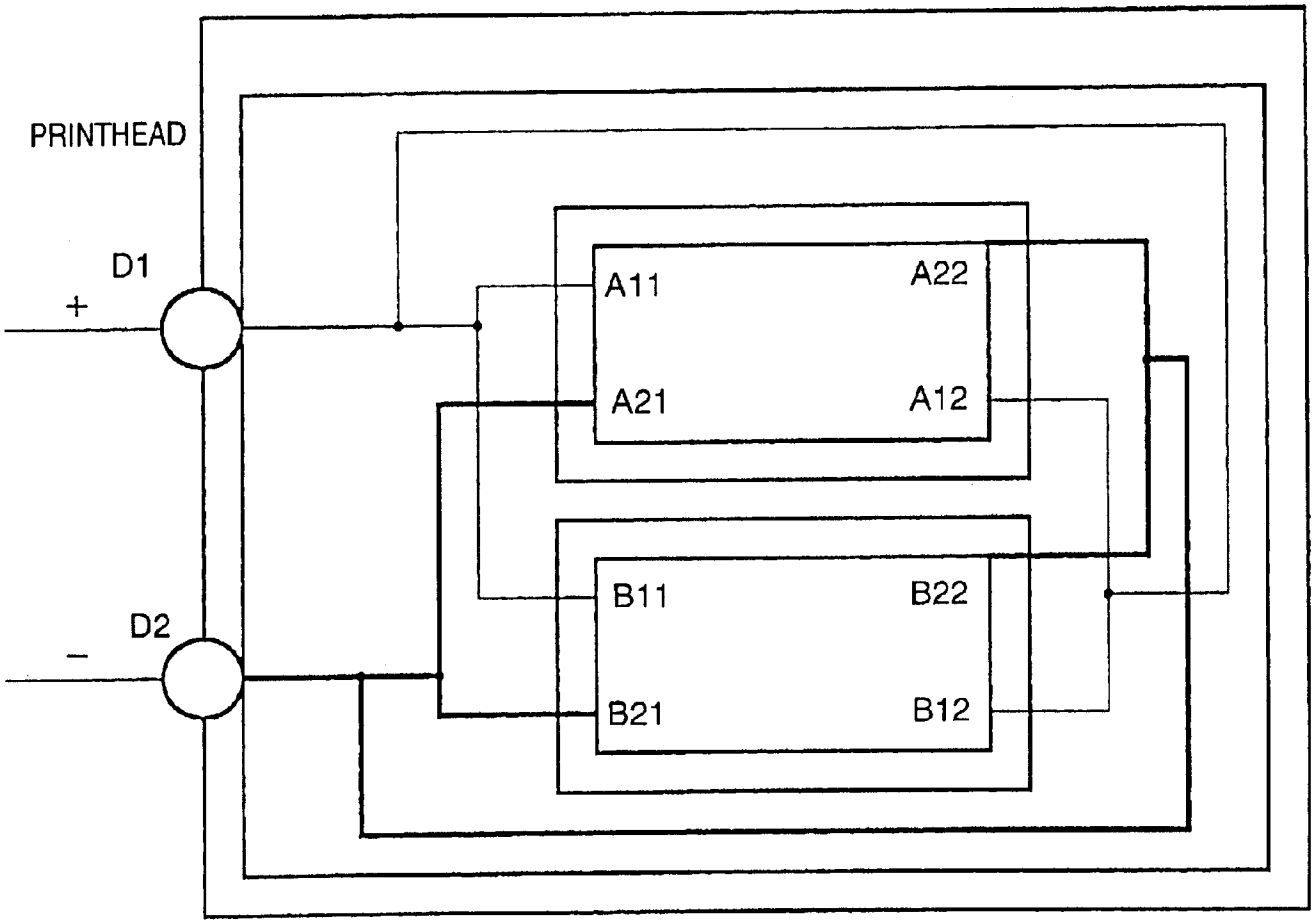
FIG. 31 is a view showing a power supply path in a printhead of the second embodiment.

Also, when a plurality of chips of the same driving conditions are used in a single printhead as shown in FIG. 31, the printhead is so designed that wiring resistances are equal from a power input terminal D1 to power input terminals A11, A12, B11, and B12 of the printhead (analogously, from a GND terminal D2 to A21, A22, B21, and B22). That is, since the numbers of simultaneous ink discharging nozzles of the power supply systems are totaled, the durability or the discharge performance varies in accordance with the nozzle position if there is a voltage drop difference resulting from the nozzle position. If chips having different driving conditions are present, e.g., if the sizes of printhead heaters are different, it is possible to use separate power supply lines for these chips as described above, or to make voltage drops (=(current value)×(wiring resistance)) equal to each other by using wiring resistances.

The average number of simultaneous ink discharging nozzles presumably has a certain upper limit when limitations on an ink deposition amount with respect to a printing medium or division of a printing pass is taken into consideration. That is, although the number of simultaneous ink discharging nozzles may exceed this upper limit in certain instances, the average number of simultaneous ink discharging nozzles is not so large. Hence, voltage drops are suppressed to be low by capacitor components, and driving is performed by an excess driving pulse width.

Figure 32:
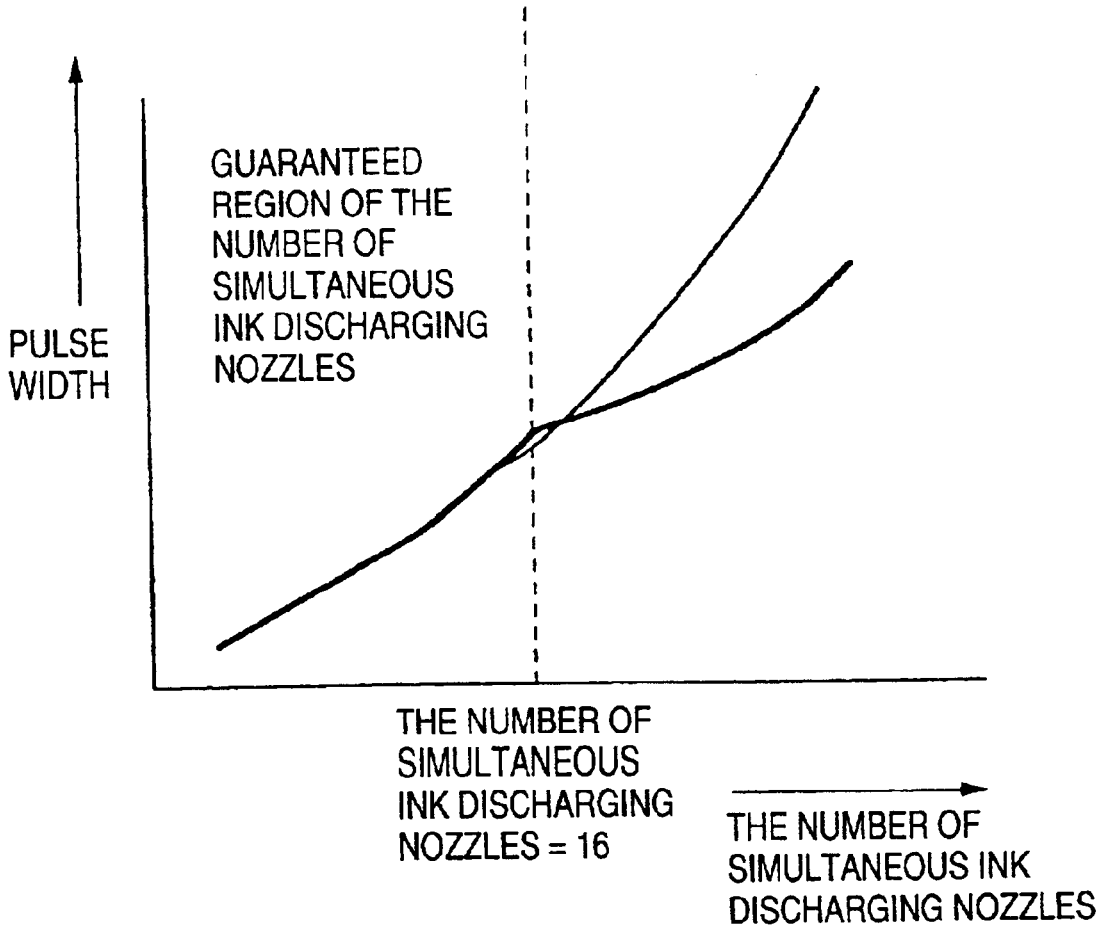
FIG. 32 is a graph showing the relationship between the number of simultaneous ink discharging nozzles and the pulse width when the pulse width is narrowed for the number of simultaneous ink discharging nozzles equal to or larger than the upper limit in the second embodiment.

To avoid this, this upper limit is set to be the number of simultaneous ink discharging nozzles=16. An increase in the pulse width caused by this number of simultaneous ink discharging nozzles is, as shown in FIG. 32, so designed as to be suppressed to about 60 to 80% of a pulse width obtained by a driving pulse calculation for the upper limit (16) of the number of simultaneous ink discharging nozzles or more. FIG. 33 shows a driving pulse width table in this case.

This upper limit of the number of simultaneous ink discharging nozzles also changes in accordance with a printing mode in multi-pass printing for performing printing complementarily using a plurality of passes in the main scanning direction of the head (in four passes, 25% is MAX for each color; in eight passes, 12.5%). Accordingly, it is effective to change the position at which this pulse width is deviated from a calculated value or change the deviation of a driving pulse in accordance with a printing mode by changing the upper limit of the number of simultaneous ink discharging nozzles.

Figure 34:
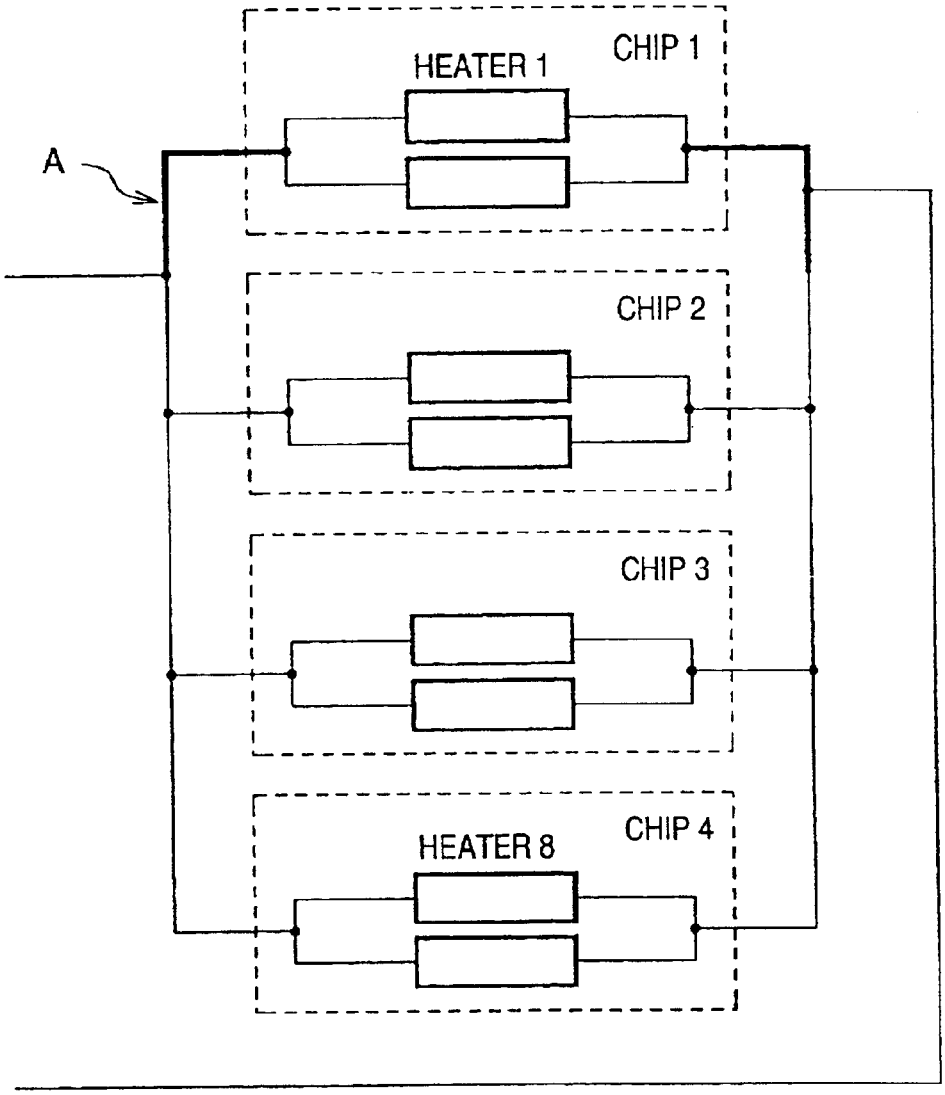
FIG. 34 is a view showing an example in which the number of simultaneous ink discharging nozzles=8 is uniformly distributed.
Figure 35:
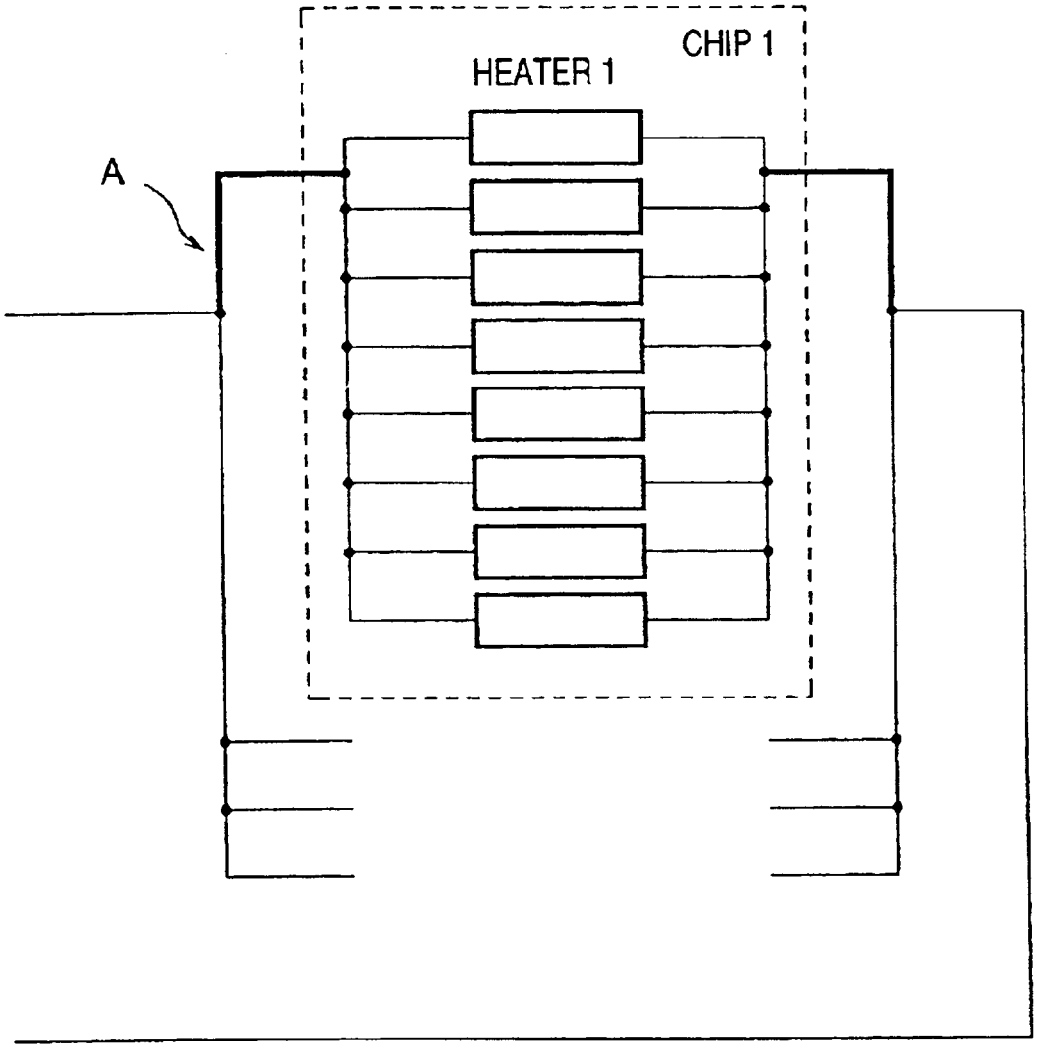
FIG. 35 is a view showing a case in which the number of simultaneous ink discharging nozzles=8 is concentrated to one chip.
Figure 36:
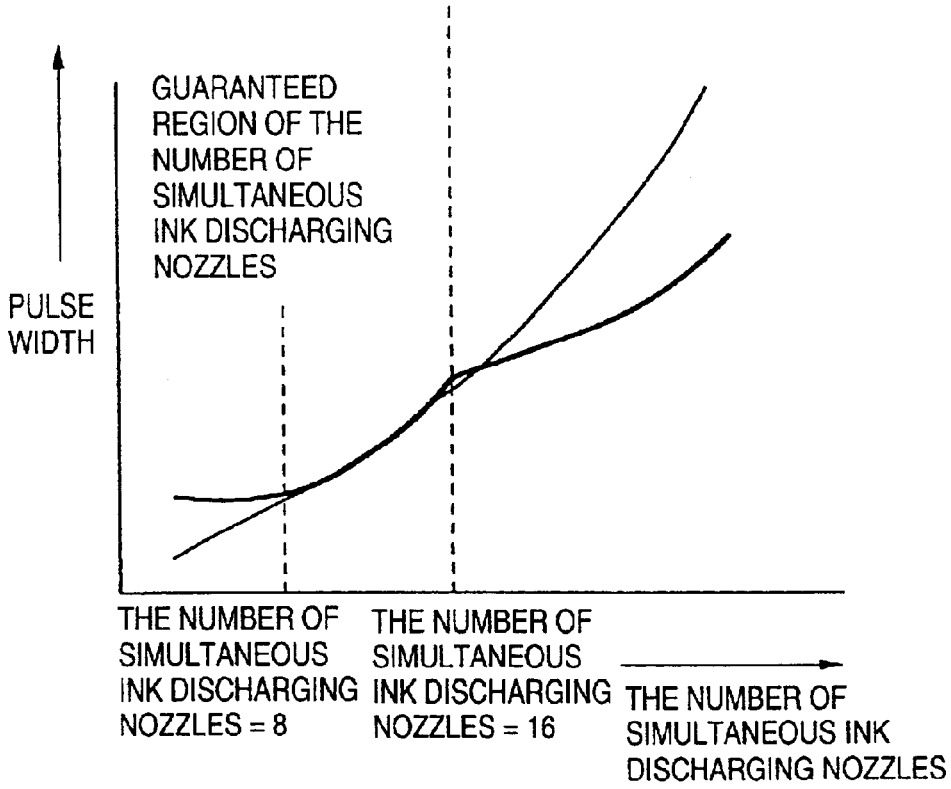
FIG. 36 is a graph-showing the relationship between the number of simultaneous ink discharging nozzles and the pulse width when the pulse width is increased for a small number of simultaneous ink discharging nozzles by taking account of one-pass printing in the second embodiment.

FIG. 34 shows an example in which the number of simultaneous ink discharging nozzles is uniformly distributed to chips and heaters. In a case like this, the effect of compensating for voltage drops by control of the driving pulse width according to the present invention is large. On the other hand, if discharge is concentrated to one chip owing to a printing mode or in one-pass printing as shown in FIG. 35, a wiring resistance in a portion indicated by the thick line in FIG. 35 is no longer negligible. This induces a large voltage drop for the same number of simultaneous ink discharging nozzles. To prevent this, it is effective to change the driving pulse width table in accordance with a printing mode, e.g., increase the driving pulse width only in one-pass printing. Alternatively, since the number of simultaneous ink discharging nozzles is limited to 0 to 8 in one-pass printing (in the second embodiment), it is effective to increase the pulse width only when the number of simultaneous ink discharging nozzles is 8 or less as shown in FIG. 36, without changing the table in accordance with a printing mode. When this is the case, a driving pulse width table is as shown in FIG. 37.

When the voltage drop changes depending on the number of simultaneous ink discharging nozzles for each printing mode such as the number of passes or the number of colors used, the optimal driving pulse width must preferably be changed for each printing mode. In the table system (FIG. 20) for setting the pulse width itself for pulse width correction for compensating for the voltage drop by the number of simultaneous ink discharging nozzles for the driving pulse No. determined by the heater rank and TrON rank of the printhead and the environmental temperature, the table shown in FIG. 20 must be prepared for each printing mode to increase the table capacity. In FIG. 20, the number of driving pulses is 16, and the number of ranks of the number of simultaneous ink discharging nozzles is 4. If the number of printhead chips increases to increase the number of simultaneous ink discharging nozzles, this increases the number of ranks of the simultaneous ink discharging nozzles. The capacity of the table for each printing mode inevitably increases. To solve this problem, the table configuration in FIG. 27 is employed in place of the table configuration in FIG. 20 in which the pulse width is directly designated. The table in FIG. 27 stores each simultaneous ink discharging pulse No. in the form of an index No. representing the table contents as a combination of the driving pulse No. and the number of simultaneous ink discharging nozzles. In addition, another table is prepared to store the relationship between the simultaneous ink discharging pulse No. and the P2 set value for setting the fall time of the pulse width. More specifically, only one table (FIG. 27) representing the driving pulse No. and the number of simultaneous ink discharge nozzles is prepared, while the table (FIG. 38) representing the relationship between the simultaneous ink discharging pulse No. and the P2 set value is prepared for each printing mode. The optimal pulse width can be set for each printing mode without increasing the table capacity. In this case, since the simultaneous ink discharging pulse No. is merely an index No. for determining the P2 set value, the correlation between the No. value and the pulse width is not always required. All "0"s are assigned to the discharge range of 0 to 7 as the number of simultaneous ink discharge nozzles for the driving pulse Nos. 1 to 4 in FIG. 2–7. Assume that the same pulse width must be set in a printing mode A, and that different pulse widths must be set for the driving pulse Nos. 1 and 2 and the driving pulse Nos. 3 and 4 in a printing mode B. Using a driving pulse No. and a simultaneous ink discharging pulse No. (No. 20 in this case) not used in the table of simultaneous ink discharging pulse Nos., a table having the contents shown in FIG. 39 is prepared. The table representing the relationship between the simultaneous ink discharging pulse No. and the P2 set value for each mode is replaced with a table shown in FIG. 40, thereby allowing optimal control for each printing mode without increasing the table contents any more than necessary.

In discharge such as predischarge, a discharge pattern entirely different from patterns in printing is often used. Therefore, also in this predischarge it is effective to change the driving pulse width table. Alternatively, if the number of simultaneous ink discharging nozzles in predischarge is limited, it is effective to increase the pulse width for the number of simultaneous ink discharging nozzles smaller than the limit. In predischarge, a discharge pattern is often limited to full-nozzle discharge. In this case, the number of simultaneous ink discharging nozzles remains the same. Hence, a fixed pulse can be used without controlling the driving pulse width by the number of simultaneous ink discharging nozzles according to the present invention.

In the second embodiment as described above, a driving pulse width table corresponding to the specifications of a printing apparatus is generated, and a driving pulse is generated by using this table. Accordingly, pulse width control for correcting a voltage drop caused by an increase in the number of simultaneous ink discharging nozzles can be appropriately performed even when the pulse width changes with temperature change. It is also possible to prevent printing density unevenness or landing errors due to temperature change and at the same time improve the durability by performing pulse width control on the basis of the number of simultaneous ink discharging nozzles.

The above embodiments have been explained by assuming that a droplet discharged from a printhead is ink and that a liquid contained in an ink tank is ink. However, the content of the ink tank is not limited to ink. For example, the ink tank can also contain a processing solution to be discharged onto a printing medium to increase the fixing properties, water resistance, or quality of a printed image.

The above embodiments can increase the density and resolution of printing by using a system which includes a means (e.g., an electrothermal transducer or a laser beam) for generating thermal energy as energy used to discharge ink and causes a state change of the ink by this thermal energy, among other inkjet printing systems.

As a representative arrangement or principle, it is preferable to use the basic principle disclosed in, e.g., U.S. Pat. No. 4,723,129 or 4,740,796. This system is applicable to both a so-called on-demand apparatus and continuous apparatus. The system is particularly effective in an on-demand apparatus because at least one driving signal which corresponds to printing information and which gives a rapid temperature rise exceeding nucleate boiling is applied to an electrothermal transducer which corresponds to a sheet or channel holding a liquid (ink), thereby causing this electrothermal transducer to generate thermal energy and cause film boiling on the thermal action surface of a printhead, and consequently a bubble can be formed in the liquid (ink) in one-to-one correspondence with the driving signal. By growth and shrinkage of this bubble, the liquid (ink) is discharged from a discharge orifice to form at least one droplet. This driving signal is more preferably a pulse signal because growth and shrinkage of a bubble are instantaneously appropriately performed, so discharge of the liquid (ink) having high response is achieved.

This pulse driving signal is preferably a signal described in U.S. Pat. No. 4,463,359 or 4,345,262. Note that superior printing can be performed by the use of conditions described in U.S. Pat. No. 4,313,124 which is the invention concerning the rate of temperature rise on the thermal action surface.

The arrangement of a printhead can be the combination (a linear liquid channel or a right-angle liquid channel) of the discharge orifices, liquid channels, and electrothermal transducers disclosed in the specifications described above. The present invention also includes arrangements using U.S. Pat. Nos. 4,558,333 and 4,459,600 in each of which the thermal action surface is placed in a bent region. Additionally, it is possible to use an arrangement based on Japanese Patent Laid-Open No. 59-123670 in which a common slot is used as a discharge portion of a plurality of electrothermal transducers or Japanese Patent Laid-Open No. 59-138461 in which an opening for absorbing the pressure wave of thermal energy is opposed to a discharge portion.

Furthermore, a full line type printhead having a length corresponding to the width of the largest printing medium printable by a printing apparatus can have a structure which meets this length by combining a plurality of printheads as disclosed in the aforementioned specifications or can be a single integrated printhead.

In addition, it is possible to use not only a cartridge type printhead, explained in the above embodiments, in which ink tanks are integrated with a printhead itself, but also an interchangeable chip type printhead which can be electrically connected to an apparatus main body and supplied with ink from the apparatus main body when attached to the apparatus main body.

Adding a recovering means or a preliminary means for a printhead to the printing apparatus described above is preferable because printing can further stabilize. Practical examples of the additional means for a printhead are a capping means, a cleaning means, a pressurizing or drawing means, and an electrothermal transducer or another heating element or a preliminary heating means combining them. A predischarge mode for performing discharge different from printing is also effective to perform stable printing.

A recording mode of the printing apparatus is not restricted to a printing mode using only a main color such as black. That is, the apparatus can have a composite color mode using different colors and a full color mode using mixed colors, regardless of whether a printhead is an integrated head or the combination of a plurality of heads.

The above embodiments are explained assuming that ink is a liquid. However, it is possible to use ink which solidifies at room temperature or less but softens or liquefies at room temperature. In inkjet systems, the general approach is to perform temperature control such that the viscosity of ink falls within a stable discharge range by adjusting the temperature of the ink itself within the range of 30° C. to 70° C. Hence, ink need only be a liquid when a printing signal used is applied to it.

Additionally, to positively prevent a temperature rise due to thermal energy, by positively using this temperature rise as energy of the state change from the solid state to the liquid state of ink, or to prevent evaporation of ink, ink which solidifies when left to stand and liquefies when heated can be used. That is, the present invention is applicable to any ink which liquefies only when thermal energy is applied, such as ink which liquefies when applied with thermal energy corresponding to a printing signal and is discharged as liquid ink, or ink which already starts to solidify when arriving at a printing medium. As described in Japanese Patent Laid-Open No. 54-56847 or 60-71260, this type of ink can be held as a liquid or solid in a recess or through-hole in a porous sheet and opposed to an electrothermal transducer in this state. In the present invention, executing the aforementioned film boiling scheme is most effective for each ink described above.

Furthermore, the printing apparatus according to the present invention can take the form of any of an integrated or separate image output terminal of an information processing apparatus such as a computer, a copying apparatus combined with a reader or the like, and a facsimile apparatus having a transmission/reception function.

The present invention can be applied to a system constituted by a plurality of devices (e.g , a host computer, interface, reader, and printer) or to an apparatus (e.g., a copying machine or facsimile apparatus) comprising a single device.

Further, the object of the present invention can also be achieved by providing a storage medium storing program codes of software for performing the aforesaid functions, according to the embodiments, in a system or an apparatus, reading the program codes with a computer (or a CPU or MPU) of the system or apparatus from the storage medium, and then executing the program codes.

In this case, the program codes read out from the storage medium realize the functions according to the embodiments, and the storage medium storing the program codes constitutes the invention.

Further, as the storage medium for providing the program codes, it is possible to use, e.g., a floppy disk, hard disk, optical disk, magnetooptical disk, CD-ROM, CD-R, magnetic tape, nonvolatile memory card, and ROM.

Furthermore, besides the aforesaid functions according to the above embodiments being realized by executing the program codes which are read out by a computer, the present invention also includes a case where an OS (Operating System) or the like running on the computer performs all or a part of actual processings in accordance with designations by the program codes and realizes the functions according to the above embodiments.

Furthermore, the present invention also includes a case where, after the program codes read out from the storage medium are written in a memory of a function extension board inserted into a computer or of a function extension unit connected to a computer, a CPU or the like of the function extension board or function extension unit performs a part or the whole of actual processing in accordance with designations by the program codes and realizes functions of the above embodiments.

When the present invention is applied to the above storage medium, this storage medium stores program codes corresponding to the flow chart shown in FIG. 29 explained earlier.

As a wide variety of different embodiments of the present invention can be made without departing from the spirit and scope thereof, it is to be understood that the invention is not limited to the specific embodiments thereof except as defined in the appended claims.

What is claimed is:

1. A printing apparatus for performing printing by using a printhead having a plurality of printing elements, comprising:

determining means for determining a fundamental pulse shape on the basis of a driving condition according to a condition of the printhead;

counting means for counting the number of simultaneously driven printing elements of the plurality of printing elements; and control means for controlling a driving pulse to be applied to printing elements used in the printing of the printing data, wherein the driving pulse is a pulse generated by modulation means for performing a modulation by changing a modulation amount of a pulse width for the number of simultaneously driven printing elements counted by said counting means on the basis of the pulse width of the fundamental pulse shape determined by said determining means.

2. The apparatus according to claim 1, wherein the driving condition includes at least one of a wiring resistance, heater resistance, driving TrON resistance, and environmental temperature of said printhead.

3. The apparatus according to claim 1, further comprising:

storage means for storing a first management table for managing the correspondence of the driving condition with the fundamental pulse shape, and a second management table for managing the correspondence of the fundamental pulse shape with a change amount of the fundamental pulse shape based on the number of simultaneously driven printing elements; and second determining means for determining a change amount of the fundamental pulse shape, which corresponds to the number of simultaneously driven printing elements, by using the second management table, wherein said determining means determines the fundamental pulse shape by using the first management table, and said control means changes the fundamental pulse shape determined by said determining means by the change amount determined by said second determining means to generate a driving pulse to be applied to printing elements used in the printing of the printing data.

4. The apparatus according to claim 3, wherein said second management table holds as an index value a change in fundamental pulse shape which is based on the number of simultaneously driven printing elements.

5. The apparatus according to claim 4, further comprising another management table representing a relationship between the change in fundamental pulse shape and the index value, the other management table being prepared for each printing mode.

6. The apparatus according to claim 5, wherein one of the printing modes is a mode for performing printing complementarily in accordance with a printing pass count.

7. The apparatus according to claim 1, wherein said control means defines the fundamental pulse shape by either one of leading and trailing edges of a pulse signal on the basis of the driving condition, and controls a driving pulse width of a driving pulse to be applied to printing elements by the other of the leading and trailing edges of the pulse signal, on the basis of the number of simultaneously driven printing elements.

8. The apparatus according to claim 7, further comprising storage means for storing a first management table for managing the correspondence of the driving condition with the fundamental pulse shape, a second management table for managing the correspondence of the fundamental pulse shape with a change amount of the fundamental pulse shape based on the number of simultaneously driven printing elements, and a third management table for managing the correspondence of rise time and fall time of the pulse signal, the driving condition, and the fundamental pulse shape, and said control means controls a pulse width of the driving pulse corresponding to the number of simultaneously driven printing elements and the driving conditions by using the third management table.

9. The apparatus according to claim 1, further comprising a plurality of printheads, and if power lines for supplying power to said printheads are independent of each other, said control means executes the control for each power line.

10. The apparatus according to claim 1, wherein said control means makes a change amount for the driving pulse, which said control means generates by changing a pulse width of the fundamental pulse shape when the number of simultaneously driven printing elements is not less than a predetermined value, smaller than a change amount for the driving pulse, which said control means generates by changing a pulse width of the fundamental pulse shape when the number of simultaneously driven printing elements is less than the predetermined value.

11. The apparatus according to claim 1, wherein said control means, when the number of simultaneously driven printing elements is not more than a predetermined value, sets a pulse width of the driving pulse larger than a pulse width calculated from the fundamental pulse shape on the basis of the number of simultaneously driven printing elements.

12. The apparatus according to claim 1, wherein if the number of simultaneously driven printing elements for use in predischarge for recovering said printhead is limited, said control means makes a pulse width of a driving pulse to be applied to printing elements used in the predischarge larger than a pulse width of a driving pulse to be applied to printing elements for use in printing which uses printing elements not less than the number of simultaneously driven printing elements.

13. The apparatus according to claim 1, wherein when predischarge for recovering said printhead is to be performed, said control means applies a driving pulse having a predetermined width to printing elements used in the predischarge.

14. The apparatus according to claim 1, wherein each printing element comprises an ink discharge unit comprising an electrothermal transducer for discharging ink by generating a bubble in the ink by heat and a discharge orifice.

15. The apparatus according to claim 1, wherein the fundamental pulse shape is selected and determined from a plurality of fundamental pulse shapes.

16. The apparatus according to claim 1, wherein the driving condition includes printhead characteristics.

17. The apparatus according to claim 1, wherein said determining means determines the fundamental pulse shape on the basis of a plurality of driving conditions according to the condition of the printhead.

18. The apparatus according to claim 1, wherein the fundamental pulse shape is a fundamental pulse width.

19. The apparatus according to claim 1, wherein functions of said determination means, said counting means and said control means are executed in a period other than a printing period.

20. The apparatus according to claim 19, wherein the period other than the printing period is at least one of a period before printing and a period during line return.

21. A method of controlling a printing apparatus for performing printing by using a printhead having a plurality of printing elements, comprising:

a determination step of determining a fundamental pulse shape on the basis of a driving condition according to a condition of the printhead;

a counting step of counting the number of simultaneously driven printing elements of the plurality of printing elements; and a control step of controlling a driving pulse to be applied to printing elements used in the printing of the printing data, wherein the driving pulse is a pulse generated by a modulation step of performing a modulation by changing a modulation amount of a pulse width for the number of simultaneously driven printing elements counted in said counting step on the basis of the pulse width of the fundamental pulse shape determined in said determination step.

22. The method according to claim 21, wherein the driving condition includes at least one of a wiring resistance, heater resistance, driving TrON resistance, and environmental temperature of said printhead.

23. The method according to claim 21, further comprising:

a storage step of storing a first management table for managing the correspondence of the driving condition with the fundamental pulse shape, and a second management table for managing the correspondence of the fundamental pulse shape with a change amount of the fundamental pulse shape based on the number of simultaneously driven printing elements; and a second determination step of determining a change amount of the fundamental pulse shape, which corresponds to the number of simultaneously driven printing elements, by using the second management table, wherein the determination step determines the fundamental pulse shape using the first management table, and the control step comprises changing the fundamental pulse shape determined in the determination step by the change amount determined in the second determination step to generate a driving pulse to be applied to printing elements used in the printing of the printing data.

24. The method according to claim 23, wherein said second management table holds as an index value a change in fundamental pulse shape which is based on the number of simultaneously driven printing elements.

25. The method according to claim 24, further comprising another management table representing a relationship between the change in fundamental pulse shape and the index value, the other management table being prepared for each printing mode.

26. The method according to claim 25, wherein one of the printing modes is a mode for performing printing complementarily in accordance with a printing pass count.

27. The method according to claim 21, wherein the control step comprises defining the fundamental pulse shape by either one of leading and trailing edges of a pulse signal on the basis of the driving condition, and controlling a driving pulse width of a driving pulse to be applied to printing elements by the other of the leading and trailing edges of the pulse signal, on the basis of the number of simultaneously driven printing elements.

28. The method according to claim 27, further comprising a storage step of storing a first management table for managing the correspondence of the driving condition with the fundamental pulse shape, a second management table for managing the correspondence of the fundamental pulse shape with a change amount of the fundamental pulse shape based on the number of simultaneously driven printing elements, and a third management table for managing the correspondence of rise time and fall time of the pulse signal, the driving condition, and the fundamental pulse shape, and said control step comprises controlling a pulse width of the driving pulse corresponding to the number of simultaneously driven printing elements and the driving conditions by using the third management table.

29. The method according to claim 21, wherein said printing apparatus comprises a plurality of printheads, and if power lines for supplying power to said printheads are independent of each other, the control step comprises executing the control for each power line.

30. The method according to claim 21, wherein the control step comprises making a change amount for the driving pulse, which the control step generates by changing a pulse width of the fundamental pulse shape when the number of simultaneously driven printing elements is not less than a predetermined value, smaller than a change amount for the driving pulse, which the control step generates by changing a pulse width of the fundamental pulse shape when the number of simultaneously driven printing elements is less than the predetermined value.

31. The method according to claim 21, wherein the control step, when the number of simultaneously driven printing elements is not more than a predetermined value, sets a pulse width of the driving pulse larger than a pulse width calculated from the fundamental pulse shape on the basis of the number of simultaneously driven printing elements.

32. The method according to claim 21, wherein if the number of simultaneously driven printing elements for use in predischarge for recovering said printhead is limited, the control step comprises making a pulse width of a driving pulse to be applied to printing elements used in the predischarge larger than a pulse width of a driving pulse to be applied to printing elements for use in printing which uses printing elements not less than the number of simultaneously driven printing elements.

33. The method according to claim 21, wherein when predischarge for recovering said printhead is to be performed, the control step comprises applying a driving pulse having a predetermined width to printing elements used in the predischarge.

34. The method according to claim 21, wherein each printing element comprises an ink discharge unit comprising an electrothermal transducer for discharging ink by generating a bubble in the ink by heat and a discharge orifice.

35. The method according to claim 21, wherein the fundamental pulse shape is selected and determined from a plurality of fundamental pulse shapes.

36. The method according to claim 21, wherein the driving condition includes printhead characteristics.

37. The method according to claim 21, wherein said determination step determines the fundamental pulse shape on the basis of a plurality of driving conditions according to the condition of the printhead.

38. The method according to claim 21, wherein the fundamental pulse shape is a fundamental pulse width.

39. The method according to claim 21, wherein said determination step, said counting step and said control step are executed in a period other than a printing period.

40. The method according to claim 39, wherein the period other than the printing period is at least one of a period before printing and a period during line return.

41. A computer-readable memory storing program codes of control of a printing apparatus for performing printing by using a printhead having a plurality of printing elements, comprising:

a program code of a determination step of determining a fundamental pulse shape on the basis of a driving condition according to a condition of the printhead;

a program code of a counting step of counting the number of simultaneously driven printing elements of the plurality of printing elements; and a program code of a control step of controlling a driving pulse to be applied to printing elements used in the printing of the printing data, wherein the driving pulse is a pulse generated by a modulation step of performing a modulation by changing a modulation amount of a pulse width for the number of simultaneously driven printing elements counted in said counting step on the basis of the pulse width of the fundamental pulse shape determined in said determination step.

42. The computer-readable memory according to claim 41, wherein the fundamental pulse shape is a fundamental pulse width.

43. The computer-readable memory according to claim 41, wherein said determination step, said counting step and said control step are executed in a period other than a printing period.

44. The computer-readable memory according to claim 43, wherein the period other than the printing period is at least one of a period before printing and a period during line return.

* * * * *

UNITED STATES PATENT AND TRADEMARK OFFICE

CERTIFICATE OF CORRECTION

PATENT NO. : 6,827,413 B1
APPLICATION NO. : 09/628661
DATED : December 7, 2004
INVENTOR(S) : Kawatoko et al.

It is certified that error appears in the above-identified patent and that said Letters Patent is hereby corrected as shown below:

COLUMN 13:

Line 7, "OMA" should read --DMA--.

COLUMN 18:

Line 20, "rank.TrON rank." should read --rank •TrON rank.--.

Signed and Sealed this

Twelfth Day of February, 2008

JON W. DUDAS
*Director of the United States Patent and Trademark Office*